US012766375B2

(12) United States Patent
Morales et al.

(10) Patent No.: US 12,766,375 B2
(45) Date of Patent: Oct. 20, 2026

(54) GOLF CLUB HEADS WITH NORMALIZED IMPACT RESPONSE

(71) Applicant: KARSTEN MANUFACTURING CORPORATION, Phoenix, AZ (US)

(72) Inventors: Eric J. Morales, Laveen, AZ (US); Lance R. White, Phoenix, AZ (US); Joshua A. Degerness, Scottsdale, AZ (US); Mitchell J. Simonet, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 279 days.

(21) Appl. No.: 18/472,219

(22) Filed: Sep. 21, 2023

(65) Prior Publication Data

US 2024/0091601 A1 Mar. 21, 2024

Related U.S. Application Data

(60) Provisional application No. 63/376,586, filed on Sep. 21, 2022.

(51) Int. Cl.
*A63B 53/04* (2015.01)

(52) U.S. Cl.
CPC ..... *A63B 53/0466* (2013.01); *A63B 53/0408* (2020.08); *A63B 53/0416* (2020.08); *A63B 2053/0495* (2013.01)

(58) Field of Classification Search
CPC ..... A63B 53/0466; A63B 53/0433; A63B 2053/0495
See application file for complete search history.

(56) References Cited

U.S. PATENT DOCUMENTS

| | | | |
|---|---|---|---|
| 4,511,145 | A | 4/1985 | Schmidt |
| 4,602,787 | A | 7/1986 | Sugioka |
| 5,000,454 | A | 3/1991 | Soda |
| 5,141,230 | A | 8/1992 | Antonious |
| 5,451,058 | A | 9/1995 | Price |
| 5,839,975 | A | 11/1998 | Lundberg |
| 5,941,782 | A | 8/1999 | Cook |
| 6,299,547 | B1 | 10/2001 | Kosmatka |
| 6,309,311 | B1 | 10/2001 | Lu |
| 6,383,090 | B1 | 5/2002 | Bryan |
| 6,695,715 | B1 | 2/2004 | Chikaraishi |
| 6,835,145 | B2 | 12/2004 | Tsurumaki |
| 6,852,038 | B2 | 2/2005 | Yabu |
| 6,878,073 | B2 | 4/2005 | Takeda |
| 6,991,559 | B2 | 1/2006 | Yabu |

(Continued)

FOREIGN PATENT DOCUMENTS

| | | |
|---|---|---|
| CN | 2661252 | 12/2004 |
| CN | 108015223 | 5/2018 |

(Continued)

OTHER PUBLICATIONS

Int'l Search Report and Written Opinion from corresponding PCT appl. No. PCT/US2020/050769, filed on Sep. 14, 2020.

*Primary Examiner* — Raeann Gorden

(57) ABSTRACT

A wood-type golf club head having a normalized impact response across the entire face of the club. Components of the club head can provide structural rigidity to the club head at rest and during low-energy impacts and provide flexure during high-energy impacts.

16 Claims, 22 Drawing Sheets

(56) References Cited

U.S. PATENT DOCUMENTS

| | | | |
|---|---|---|---|
| 7,056,228 | B2 | 6/2006 | Beach |
| 7,056,229 | B2 | 6/2006 | Chen |
| 7,247,103 | B2 | 7/2007 | Beach |
| 7,351,161 | B2 | 4/2008 | Beach |
| 7,445,563 | B1 | 11/2008 | Werner |
| 7,445,564 | B2 | 11/2008 | Kusumoto |
| 7,749,104 | B2 | 7/2010 | Brekke |
| 7,775,906 | B2 | 8/2010 | Kusumoto |
| 7,828,676 | B2 | 11/2010 | Wada |
| 7,854,666 | B2 | 12/2010 | Horacek |
| 7,914,393 | B2 | 3/2011 | Hirsch |
| 7,998,000 | B2 | 8/2011 | Brekke |
| 8,033,932 | B2 | 10/2011 | Wada |
| 8,323,121 | B2 | 12/2012 | Wada |
| 8,357,056 | B2 | 1/2013 | Horacek |
| 8,523,702 | B2 | 9/2013 | Thomas |
| 8,540,587 | B2 | 9/2013 | Hirsch |
| 8,591,352 | B2 | 11/2013 | Hirano |
| 8,608,585 | B2 | 12/2013 | Stites |
| 8,727,910 | B2 | 5/2014 | Nakano |
| 8,758,164 | B2 | 6/2014 | Breier |
| 8,827,834 | B2 | 9/2014 | Horacek |
| 8,956,244 | B1 | 2/2015 | Westrum |
| 9,333,390 | B1 | 5/2016 | Manwaring |
| 9,345,936 | B1 | 5/2016 | Westrum |
| 9,457,241 | B2 | 10/2016 | Hebreo |
| 9,486,677 | B1 | 11/2016 | Seluga |
| 9,597,558 | B1 | 3/2017 | Seluga |
| 9,597,561 | B1 | 3/2017 | Seluga |
| 9,623,291 | B2 | 4/2017 | Greensmith |
| 9,717,962 | B1 | 8/2017 | Seluga |
| 9,757,629 | B2 | 9/2017 | Seluga |
| 9,776,054 | B2 | 10/2017 | Horacek |
| 9,776,058 | B2 | 10/2017 | Seluga |
| 9,795,840 | B2 | 10/2017 | Greensmith |
| 9,814,947 | B1 | 11/2017 | Seluga |
| 9,814,954 | B2 | 11/2017 | Westrum |
| 9,821,199 | B1 | 11/2017 | Seluga |
| 9,901,794 | B2 | 2/2018 | Beno |
| 9,908,019 | B1 | 3/2018 | Seluga |
| 9,931,549 | B1 | 4/2018 | Seluga |
| 9,931,550 | B1 | 4/2018 | Seluga |
| 9,943,733 | B2 | 4/2018 | Franklin |
| 9,993,704 | B2 | 6/2018 | Hebreo |
| 10,065,085 | B2 | 9/2018 | Seluga |
| 10,076,694 | B2 | 9/2018 | Galvan |
| 10,092,797 | B2 | 10/2018 | Greensmith |
| 10,130,849 | B2 | 11/2018 | Franklin |
| 10,213,661 | B2 | 2/2019 | Seluga |
| 10,238,933 | B1 | 3/2019 | Seluga |
| 10,258,846 | B1 | 4/2019 | Nunez |
| 10,322,319 | B2 | 6/2019 | Del Rosario |
| 10,335,647 | B2 | 7/2019 | Seluga |
| 10,369,435 | B1 | 8/2019 | Myers |
| 10,406,408 | B1 | 9/2019 | Seluga |
| 10,463,925 | B2 | 11/2019 | Greensmith |
| 10,507,366 | B2 | 12/2019 | Hebreo |
| 10,518,146 | B2 | 12/2019 | Myers |
| 10,532,258 | B2 | 1/2020 | Seluga |
| 10,569,142 | B2 | 2/2020 | Del Rosario |
| 10,589,154 | B2 | 3/2020 | Seluga |
| 10,617,920 | B2 | 4/2020 | Nunez |
| 10,716,980 | B2 | 7/2020 | Myers |
| 10,850,169 | B1 | 12/2020 | Day |
| 10,888,742 | B2 | 1/2021 | Greensmith |
| 10,912,970 | B1 | 2/2021 | Hanhart |
| 10,981,040 | B2 | 4/2021 | Nunez |
| 11,027,176 | B2 | 6/2021 | Del Rosario |
| 11,135,614 | B1 | 10/2021 | Reed |
| 11,266,885 | B2 | 3/2022 | Greensmith |
| 2003/0190975 | A1 | 10/2003 | Fagot |
| 2007/0021234 | A1 | 1/2007 | Tsurumaki |
| 2007/0275792 | A1 | 11/2007 | Horacek |
| 2010/0273565 | A1* | 10/2010 | Stites ..... A63B 53/047 473/282 |
| 2012/0270674 | A1* | 10/2012 | Finn ..... A63B 53/0466 473/329 |
| 2020/0023242 | A1 | 1/2020 | Hsiao |
| 2021/0051102 | A1 | 2/2021 | Dong |
| 2021/0070242 | A1 | 3/2021 | Kang |
| 2021/0162273 | A1 | 6/2021 | Greensmith |
| 2021/0236891 | A1 | 8/2021 | Nunez |
| 2021/0339093 | A1 | 11/2021 | Seluga |
| 2021/0362181 | A1 | 11/2021 | Reed |

FOREIGN PATENT DOCUMENTS

| | | |
|---|---|---|
| GB | 2547800 | 8/2017 |
| GB | 2558011 | 7/2018 |
| GB | 2559425 | 8/2018 |
| GB | 2559487 | 8/2018 |
| JP | 05269224 | 10/1993 |
| JP | 2717759 | 9/1994 |
| JP | 4001970 | 10/1998 |
| JP | 4009359 | 10/1999 |
| JP | 2006192110 | 7/2006 |
| JP | 4566936 | 9/2007 |
| JP | 2007267777 | 10/2007 |
| JP | 2007275547 | 10/2007 |
| JP | 2008086351 | 4/2008 |
| JP | 4616912 | 3/2009 |
| JP | 2009233266 | 10/2009 |
| JP | 5256224 | 11/2010 |
| JP | 2017012743 | 1/2017 |
| JP | 2019084325 | 6/2019 |

* cited by examiner

GOLF CLUB HEADS WITH NORMALIZED IMPACT RESPONSE

CROSS REFERENCE PRIORITY

This claims the benefit of U.S. Provisional Application No. 63/376,586, filed Sep. 21, 2022, which is fully incorporated herein by reference.

FIELD OF INVENTION

This invention generally relates to golf equipment, and more particularly, to wood-type golf club heads.

BACKGROUND

Mass properties of a golf club head can be adjusted to improve one or more performance characteristics. For example, center of gravity location, moment of inertia values, and variable face configurations can be adjusted to improve forgiveness, ball speed, ball trajectory, or other performance characteristics of the golf club head. The United States Golf Association (USGA) have implemented rules that restrict certain performance characteristics of clubs.

Some club faces that would otherwise comply with these rules fail due to the presence of discrete areas of excessive impact response, informally known as "hot spots. A test impact with a hot spot may result in an impact response that causes the club to be deemed not to conform. Therefore, there is a need in the art for a wood-type golf club head having a normalized impact response across the entire face of the club.

DEFINITIONS

Figure 1:
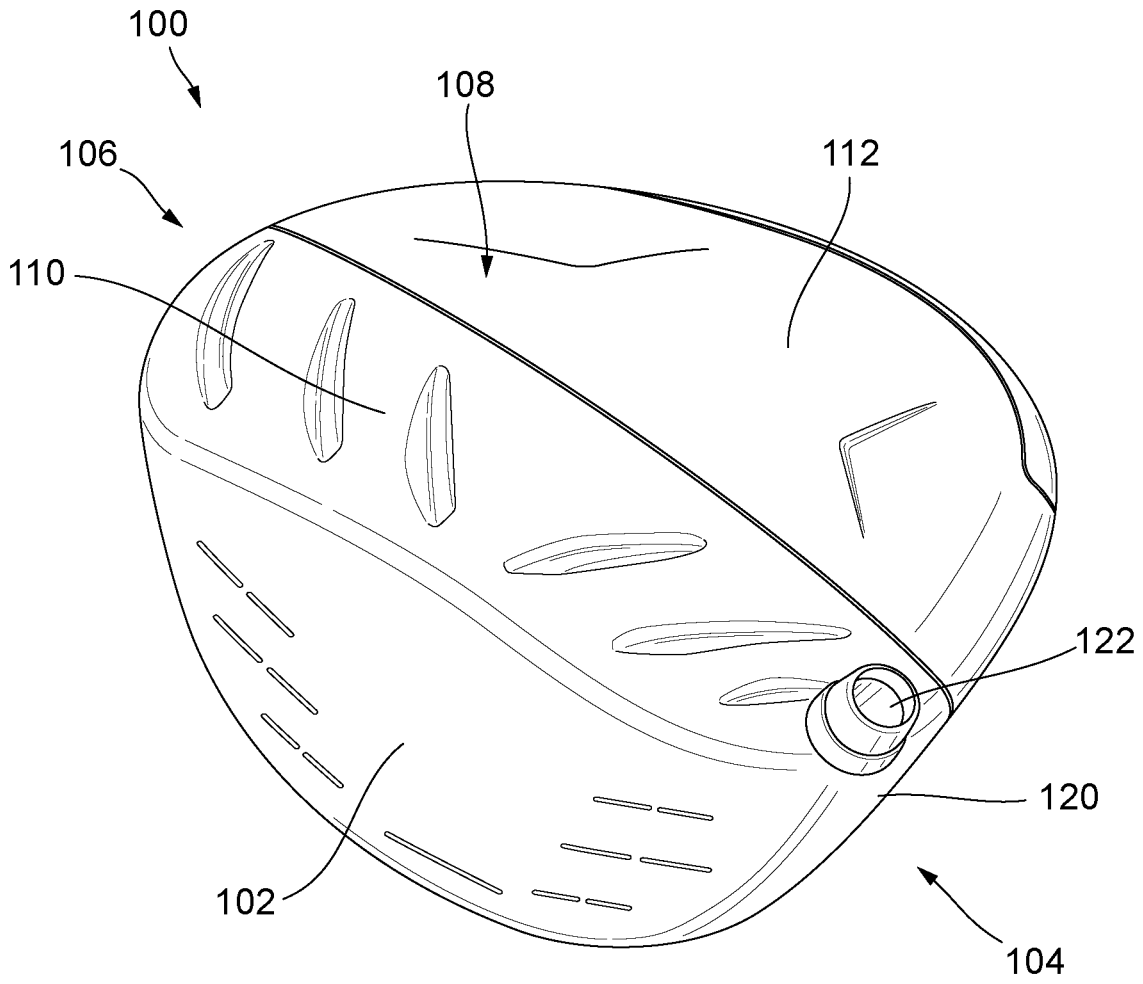
FIG. 1 illustrates a top perspective view of a wood-type club head.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments described herein are, for example, capable of operation in sequences other than those illustrated or otherwise described herein. Furthermore, the terms "include," and "have," and any variations thereof, are intended to cover a non-exclusive inclusion, such that a process, method, system, article, device, or apparatus that comprises a list of elements is not necessarily limited to those elements but may include other elements not expressly listed or inherent to such process, method, system, article, device, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the apparatus, methods, and/or articles of manufacture described herein are, for example, capable of operation in other orientations than those illustrated or otherwise described herein.

The terms "couple," "coupled," "couples," "coupling," and the like should be broadly understood and refer to connecting two or more elements or signals, electrically, mechanically and/or otherwise.

"Driver golf club heads" as used herein comprise a loft angle less than approximately 16 degrees, less than approximately 15 degrees, less than approximately 14 degrees, less than approximately 13 degrees, less than approximately 12 degrees, less than approximately 11 degrees, or less than approximately 10 degrees. Further, in many embodiments, "driver golf club heads" as used herein comprises a volume greater than approximately 400 cc, greater than approximately 425 cc, greater than approximately 445 cc, greater than approximately 450 cc, greater than approximately 455 cc, greater than approximately 460 cc, greater than approximately 475 cc, greater than approximately 500 cc, greater than approximately 525 cc, greater than approximately 550 cc, greater than approximately 575 cc, greater than approximately 600 cc, greater than approximately 625 cc, greater than approximately 650 cc, greater than approximately 675 cc, or greater than approximately 700 cc. In some embodiments, the volume of the driver can be approximately 400 cc-600 cc, 425 cc-500 cc, approximately 500 cc-600 cc, approximately 500 cc-650 cc, approximately 550 cc-700 cc, approximately 600 cc-650 cc, approximately 600 cc-700 cc, or approximately 600 cc-800 cc.

"Fairway wood golf club heads" as used herein comprise a loft angle less than approximately 35 degrees, less than approximately 34 degrees, less than approximately 33 degrees, less than approximately 32 degrees, less than approximately 31 degrees, or less than approximately 30 degrees. Further, in some embodiments, the loft angle of the fairway wood club heads can be greater than approximately 12 degrees, greater than approximately 13 degrees, greater than approximately 14 degrees, greater than approximately 15 degrees, greater than approximately 16 degrees, greater than approximately 17 degrees, greater than approximately 18 degrees, greater than approximately 19 degrees, or greater than approximately 20 degrees. For example, in other embodiments, the loft angle of the fairway wood can be between 12 degrees and 35 degrees, between 15 degrees and 35 degrees, between 20 degrees and 35 degrees, or between 12 degrees and 30 degrees.

Further, "fairway wood golf club heads" as used herein comprises a volume less than approximately 400 cc, less than approximately 375 cc, less than approximately 350 cc, less than approximately 325 cc, less than approximately 300 cc, less than approximately 275 cc, less than approximately 250 cc, less than approximately 225 cc, or less than approximately 200 cc. In some embodiments, the volume of the fairway wood can be approximately 150 cc-200 cc, approximately 150 cc-250 cc, approximately 150 cc-300 cc, approximately 150 cc-350 cc, approximately 150 cc-400 cc, approximately 300 cc-400 cc, approximately 325 cc-400 cc, approximately 350 cc-400 cc, approximately 250 cc-400 cc, approximately 250-350 cc, or approximately 275-375 cc.

"Hybrid golf club heads" as used herein comprise a loft angle less than approximately 40 degrees, less than approximately 39 degrees, less than approximately 38 degrees, less than approximately 37 degrees, less than approximately 36 degrees, less than approximately 35 degrees, less than approximately 34 degrees, less than approximately 33 degrees, less than approximately 32 degrees, less than approximately 31 degrees, or less than approximately 30 degrees. Further, in many embodiments, the loft angle of the hybrid can be greater than approximately 16 degrees, greater than approximately 17 degrees, greater than approximately 18 degrees, greater than approximately 19 degrees, greater than approximately 20 degrees, greater than approximately 21 degrees, greater than approximately 22 degrees, greater than approximately 23 degrees, greater than approximately 24 degrees, or greater than approximately 25 degrees.

Further, "hybrid golf club heads" as used herein comprise a volume less than approximately 200 cc, less than approximately 175 cc, less than approximately 150 cc, less than approximately 125 cc, less than approximately 100 cc, or less than approximately 75 cc. In some embodiments, the volume of the hybrid can be approximately 100 cc-150 cc, approximately 75 cc-150 cc, approximately 100 cc-125 cc, or approximately 75 cc-125 cc.

An "XYZ" coordinate system of the golf club head, as used herein, is based upon the geometric center of the strikeface. The golf club head dimensions as used herein can be measured based on a coordinate system as defined below. The geometric center of the strikeface defines a coordinate system having an origin located at the geometric center of the strikeface. The coordinate system defines an X axis, a Y axis, and a Z axis. The X axis extends through the geometric center of the strikeface in a direction from the heel to the toe of the fairway-type club head. The Y axis extends through the geometric center of the strikeface in a direction from the crown to the sole of golf club head. The Y axis is perpendicular to the X axis. The Z axis extends through the geometric center of the strikeface in a direction from the front end to the rear end of the golf club head. The Z axis is perpendicular to both the X axis and the Y axis.

The term or phrase "center of gravity position" or "CG location" as used herein, is the location of the club head center of gravity (CG) with respect to the secondary coordinate system, wherein the CG position is characterized by locations along the X'-axis, the Y'-axis, and the Z'-axis. The term "CGx" can refer to the CG location along the X'-axis, measured from the origin point. The term "CG height" can refer to the CG location along the Y'-axis, measured from the origin point. The term "CGy" can be synonymous with the CG height. The term "CG depth" can refer to the CG location along the Z'-axis, measured from the origin point. The term "CGz" can be synonymous with the CG depth.

The term or phrase "moment of inertia" (hereafter "MOI") as used herein, are the values measured about the CG. The term "Ixx" as used herein, is the MOI measured in the heel-to-toe direction, parallel to the X-axis. The term "Iyy" as used herein, is the MOI measured in the sole-to-crown direction, parallel to the Y-axis. The term "Izz" as used herein, is the MOI measured in the front-to-back direction, parallel to the Z-axis. The MOI values MOIxx, MOIyy, and MOIzz determine how forgiving the club head is for off-center impacts with a golf ball. A high moment of inertia Ixx and a high moment of inertia Iyy provide the club head improved feel, forgiveness, and playability.

The golf club heads described herein can be formed from a metal, a metal alloy, a composite, or a combination of metals and composites. For example, the golf club head can be formed from, but not limited to, steel, steel alloys, stainless steel alloys, nickel, nickel alloys, cobalt, cobalt alloys, titanium alloys, an amorphous metal alloy, or other similar materials. For further example, the golf club head can be formed from, but not limited to, C250 steel, C300 steel, C350 steel, 17-4 stainless steel, 15-5 stainless steel, 13-8 stainless steel, 431 stainless steel, 8620 stainless steel, 4140 stainless steel, 4340 stainless steel, 4130 stainless steel, 4330 stainless steel, 4335 stainless steel, T9s+titanium, Ti 6-4 titanium, HST-220 titanium, TSG 1 titanium, TSG 2 titanium, TSG 3 titanium, Ti 6-22-22 titanium, Ti 10-2-3 titanium, Ti 6-6-2 titanium, Ti 15-5-3 titanium, Ti-15-3-3-3 titanium, Beta-C titanium, SJ721 titanium, Super TiX-51AF titanium, SSAT-2041 titanium, and SP700 titanium.

The term characteristic time "CT" as used herein to mean a measurement used to determine the amount of time, measured in microseconds (μs), that a golf ball contacts the strikeface at the moment of impact. The characteristic time is measured by impacting a specific spot on the striking surface several times with a ball-shaped weight of a small steel pendulum. The characteristic time measurement is for wood-type club heads such as drivers, fairway woods, or hybrids. A computer program measures the amount of time the ball shaped weight contacts the strikeface at the moment of impact. CT values were based on the method outlined in the USGA's Procedure for Measuring the Flexibility of a Golf Clubhead. For example, Section 2 of the USGA's Procedure for Measuring the Flexibility of a Golf Clubhead (USGA-TPX3004, Rev. 2.0, Apr. 9, 2019) (the "Protocol For Measuring The Flexibility of A Golf Club Head").

The term, "spline method" as used herein, refers to a method to determine the location where the curvature of a surface changes. For example, the spline method can be used to determine where the surface curvature deviates from a bulge and roll curvature of the striking surface of a golf club head. The spline method can be implemented by imposing a spline onto the curved surface with an interval such that the spline indicates where a significant change in curvature begins.

The term "strikeface perimeter," as used herein, can be located along an outer edge of the striking surface, where the curvature of the striking surface deviates from the bulge and roll curvature. The striking surface comprises a striking surface area measured within the boundary of the strikeface perimeter. In one approach, the spline method, as described above, can be used to determine the location of the outer edge where the curvature deviates from the bulge and roll of the striking surface.

The terms "loft" or "loft angle" of a golf club, as used herein, refers to the angle formed between the strikeface and the shaft, as measured by any suitable loft and lie machine.

The term "geometric centerpoint," as used herein, can refer to a geometric centerpoint of the strikeface perimeter, and at a midpoint of the face height of the strikeface. In the same or other examples, the geometric centerpoint also can be centered with respect to an engineered impact zone, which can be defined by a region of grooves on the strikeface. As another approach, the geometric centerpoint of the strikeface can be located in accordance with the definition of a golf governing body such as the United States Golf Association (USGA).

The term "ground plane," as used herein, can refer to a reference plane associated with the surface on which a golf ball is placed. The ground plane can be a horizontal plane tangent to the sole at an address position.

The term "face height," as used herein, can refer to a distance measured parallel to loft plane between a top end of the strikeface perimeter and a bottom end of the strikeface perimeter.

The term "lie angle," as used herein, can refer to an angle between a hosel axis, extending through the hosel, and the ground plane. The lie angle is measured from a front view.

The "loft plane" of the driver-type golf club head, as used herein, is a plane that is tangent to the geometric center of the strikeface. The loft plane forms a loft angle with the ground plane.

The term "loft angle," as used herein, can refer to an angle measured between the loft plane and the XY plane.

The "depth" of the driver-type golf club head as used herein can be defined as a front-to-rear dimension of the driver-type golf club head.

The "height" of the driver-type golf club head as used herein can be defined as a crown-to-sole dimension of the driver-type club head. In many embodiments, the height of the club head can be measured according to a golf governing body such as the United States Golf Association (USGA).

The "length" of the driver-type golf club head as used herein can be defined as a heel-to-toe dimension of the driver-type club head. In many embodiments, the length of the club head can be measured according to a golf governing body such as the United States Golf Association (USGA).

The "face height" of the driver-type golf club head, as used herein, can be defined as a height measured parallel to loft plane between a top end of the strikeface perimeter near the crown and a bottom end of the strikeface perimeter near the sole. In these embodiments, the strikeface perimeter can be located along the outer edge of the strikeface, where the curvature deviates from the bulge and/or roll of the strikeface.

The "geometric center" of the driver-type golf club head, as used herein, is the geometric center point of a strikeface perimeter. As another approach, the geometric center of the strikeface can be located in accordance with the definition of a golf governing body such as the United States Golf Association (USGA).

The "geometric center height" of the driver-type golf club head, as used herein, is a height measured perpendicular from the ground plane to the geometric center of the driver-type club head.

The "leading edge" of the driver-type golf club head as used herein, can be identified as the most sole-ward portion of the strikeface perimeter. For example, a driver-type golf club head leading edge is the transition from the roll and bulge of the strikeface to the sole of the driver-type golf club head.

Other features and aspects will become apparent by consideration of the following detailed description and accompanying drawings. Before any embodiments of the disclosure are explained in detail, it should be understood that the disclosure is not limited in its application to the details or embodiment and the arrangement of components as set forth in the following description or as illustrated in the drawings. The disclosure is capable of supporting other embodiments and of being practiced or of being carried out in various ways. It should be understood that the description of specific embodiments is not intended to limit the disclosure from covering all modifications, equivalents and alternatives falling within the spirit and scope of the disclosure. Also, it is to be understood that the phraseology and terminology used herein is for the purpose of description and should not be regarded as limiting.

DETAILED DESCRIPTION

Described herein are various embodiments of a wood-type golf club head (e.g. drivers, fairway woods, or hybrids also referred to as "the club head") comprising a resilient member to normalize impact response across the strikeface. With impact response normalized, other aspects of the golf club head can be modified to improve overall performance. For example, a strikeface thickness of the golf club head can be reduced to increase ball speed and/or other performance characteristics. The strikeface is secured to the body to define an interior cavity. A resilient member can extend from the body, towards the strikeface, and contact a rear surface of the strikeface. Prior to impact, the resilient member has an initial, undeflected state. At impact, the resilient member elastically deforms to a deflected state, thereby storing potential energy. As the resilient member returns to the undeflected state, it converts the stored potential energy into kinetic energy that is transferred to the strikeface and, ultimately, the golf ball. The resilient member can be configured to normalize the reaction of the strikeface at impact. This feature further enables strikeface design to increase either directly, through release of kinetic energy back to the strikeface, or indirectly by allowing other features of the golf club head to be modified, such as strikeface thickness.

I. GENERAL DESCRIPTION OF A GOLF CLUB HEAD

Figure 2:
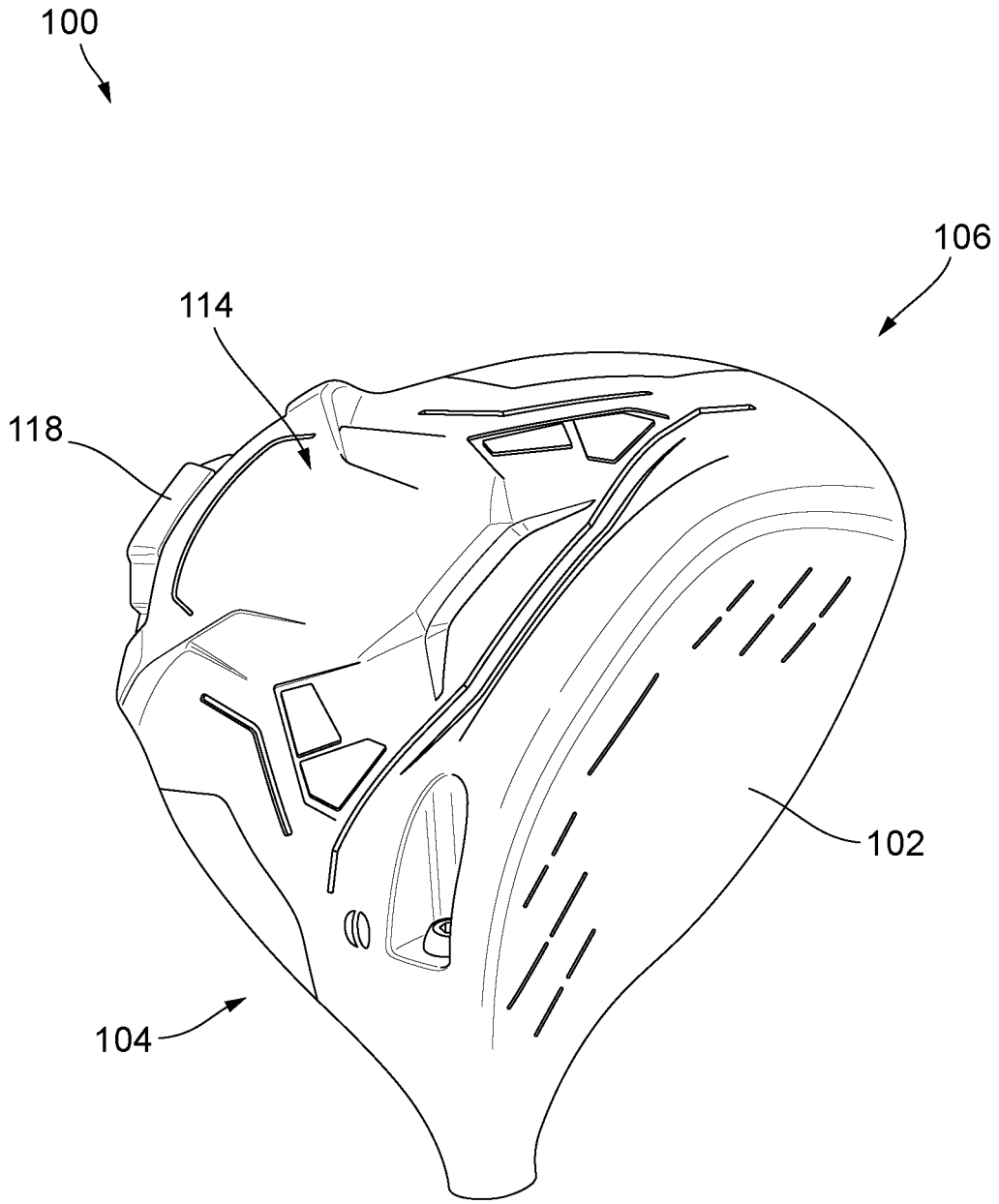
FIG. 2 illustrates a bottom perspective view of the wood-type club head of FIG. 1.
Figure 3:
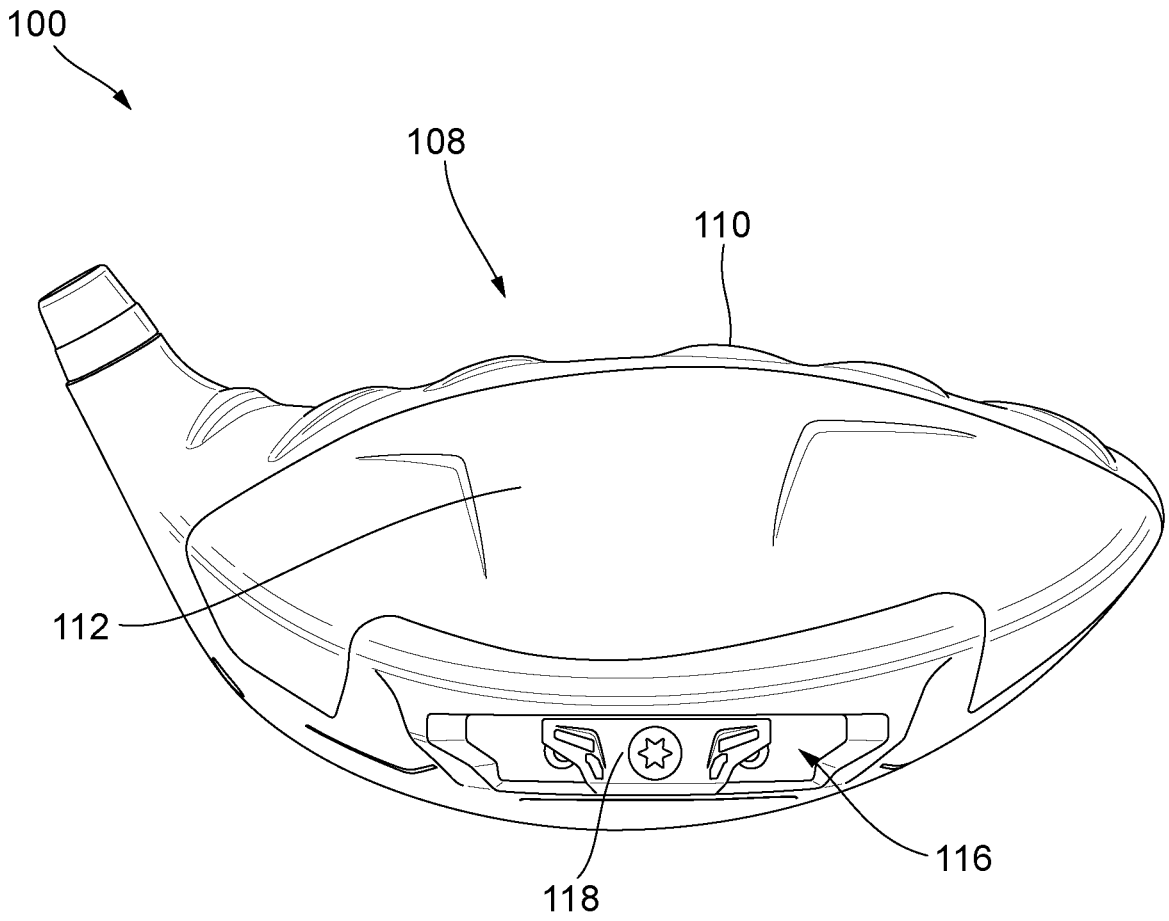
FIG. 3 illustrates a rear view of the wood-type club head of FIG. 1.
Figure 4A:
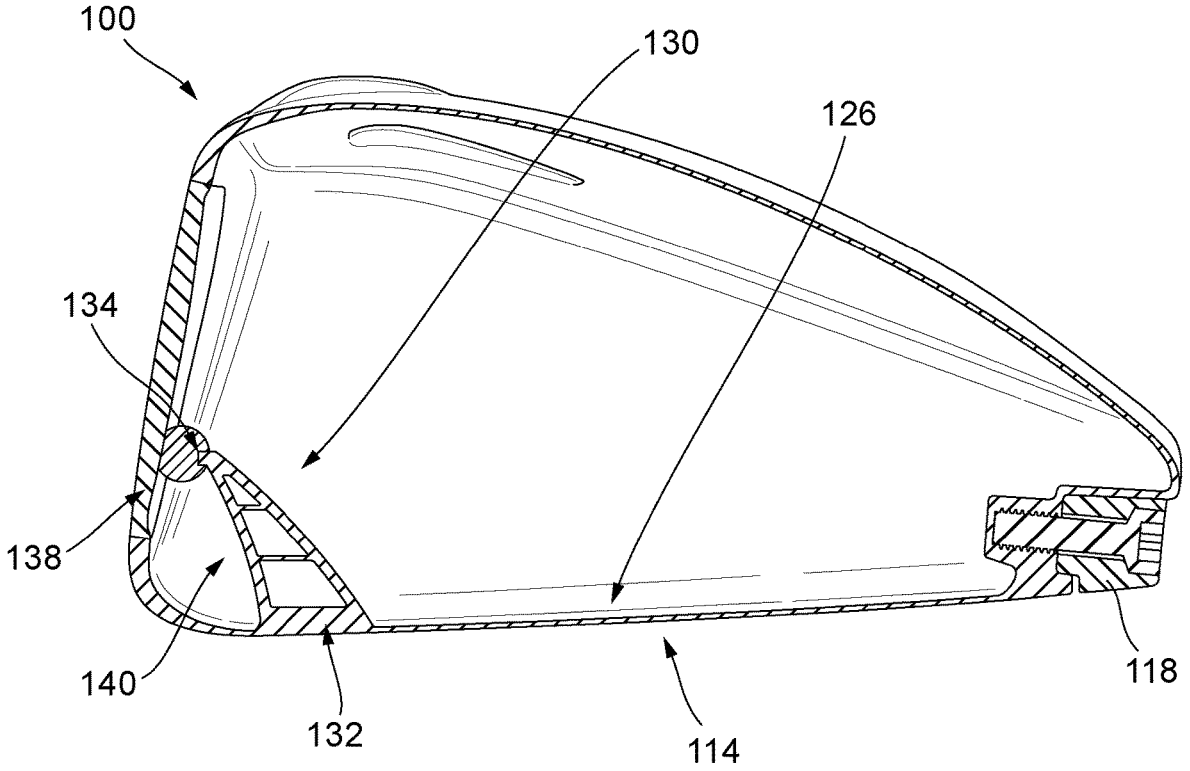
FIG. 4A illustrates a cross-sectional side view of the wood-type golf club head with a normalized ball strike response.
Figure 4B:
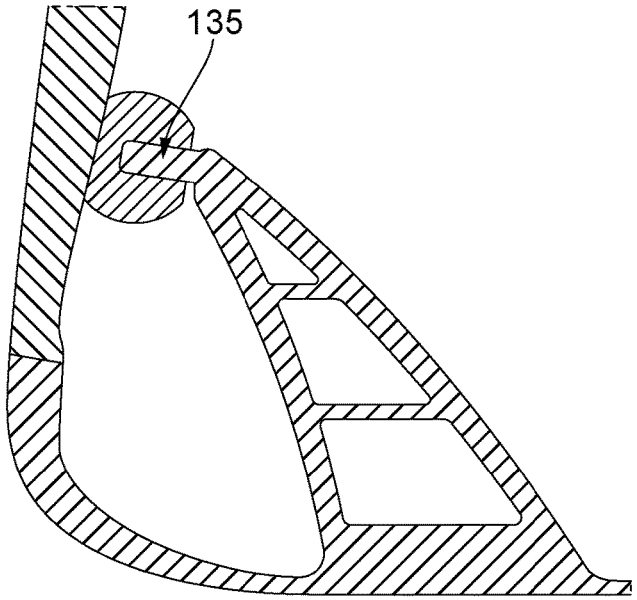
FIG. 4B illustrates an enlarged side view, in cross-section, of the wood-type club head of FIG. 4A.
Figure 5:
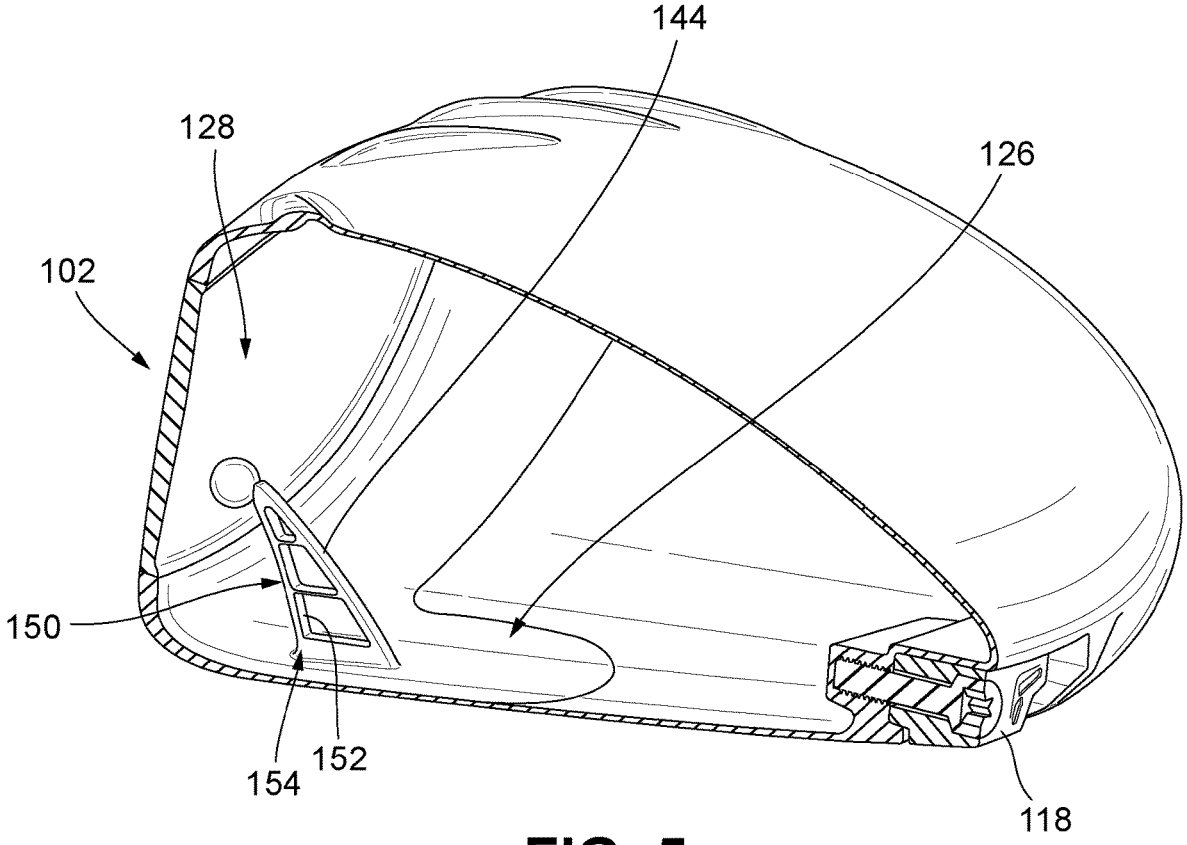
FIG. 5 illustrates a perspective view, in cross-section, of the wood-type club head of FIG. 4A.
Figure 6:
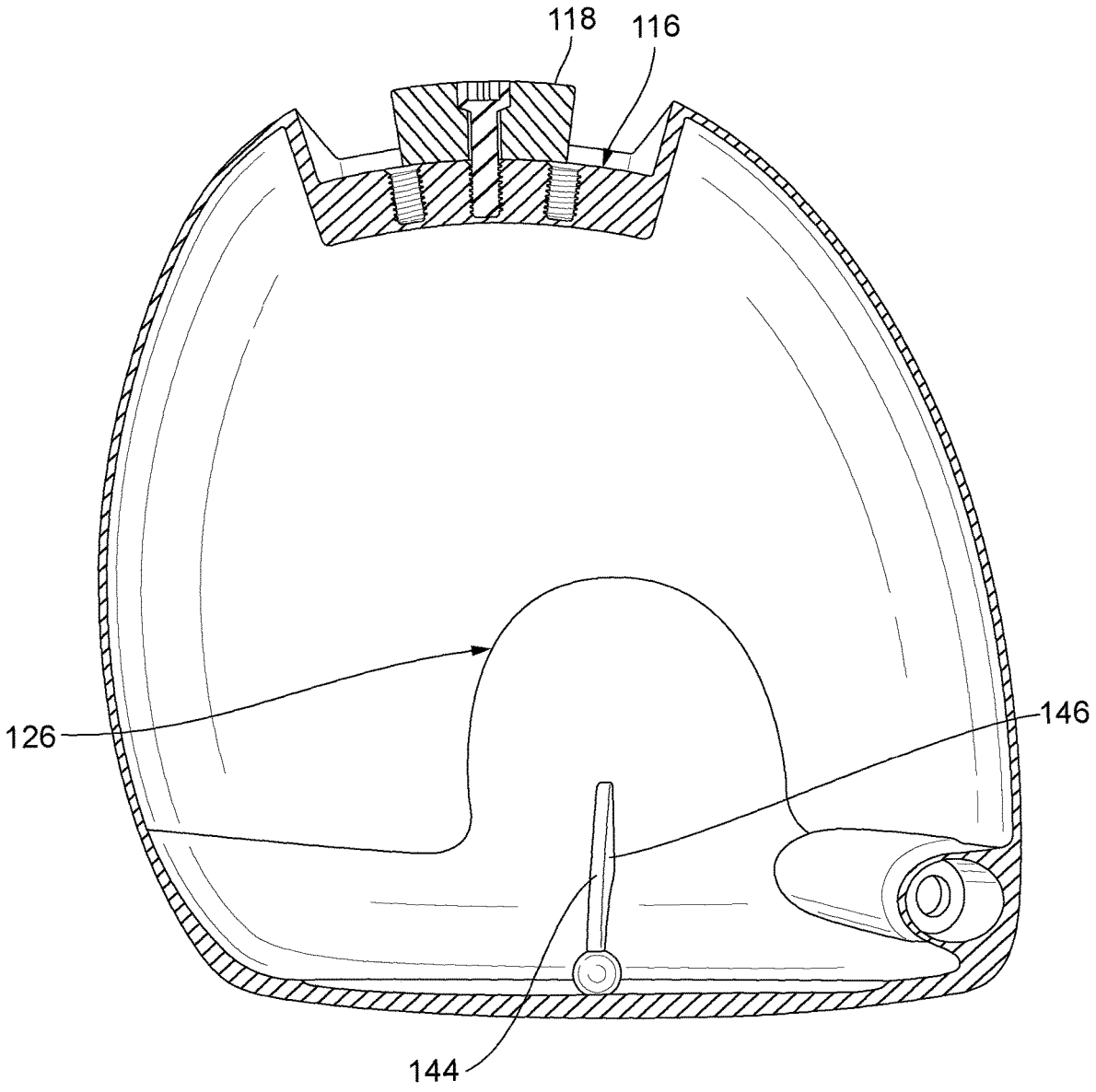
FIG. 6 illustrates a top view, in cross-section, of the wood-type club head of FIG. 4A.
Figure 7:
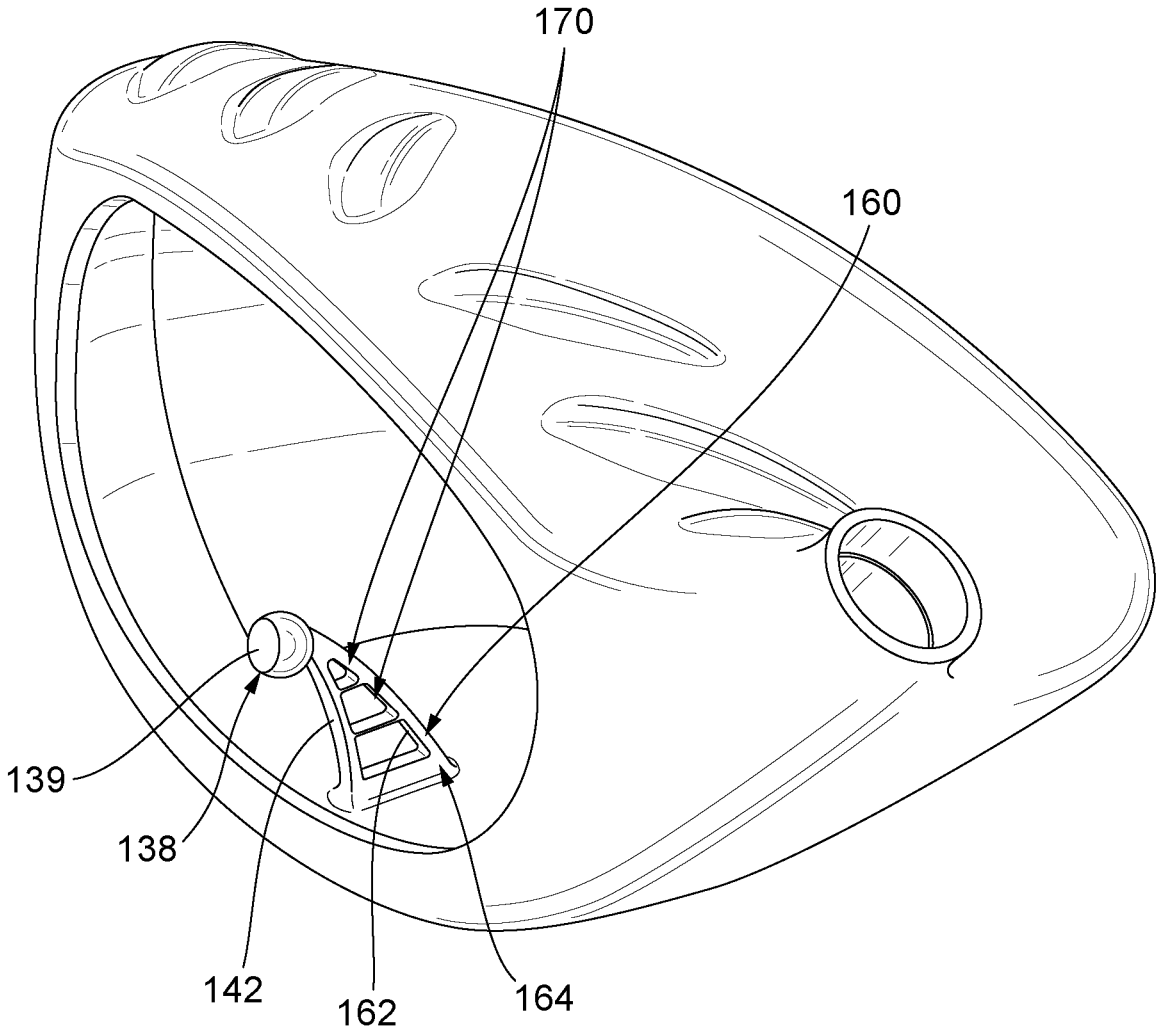
FIG. 7 illustrates a perspective view of the wood-type club head of FIG. 4A, with a front portion removed to show an interior of the wood-type club head.
Figure 8:
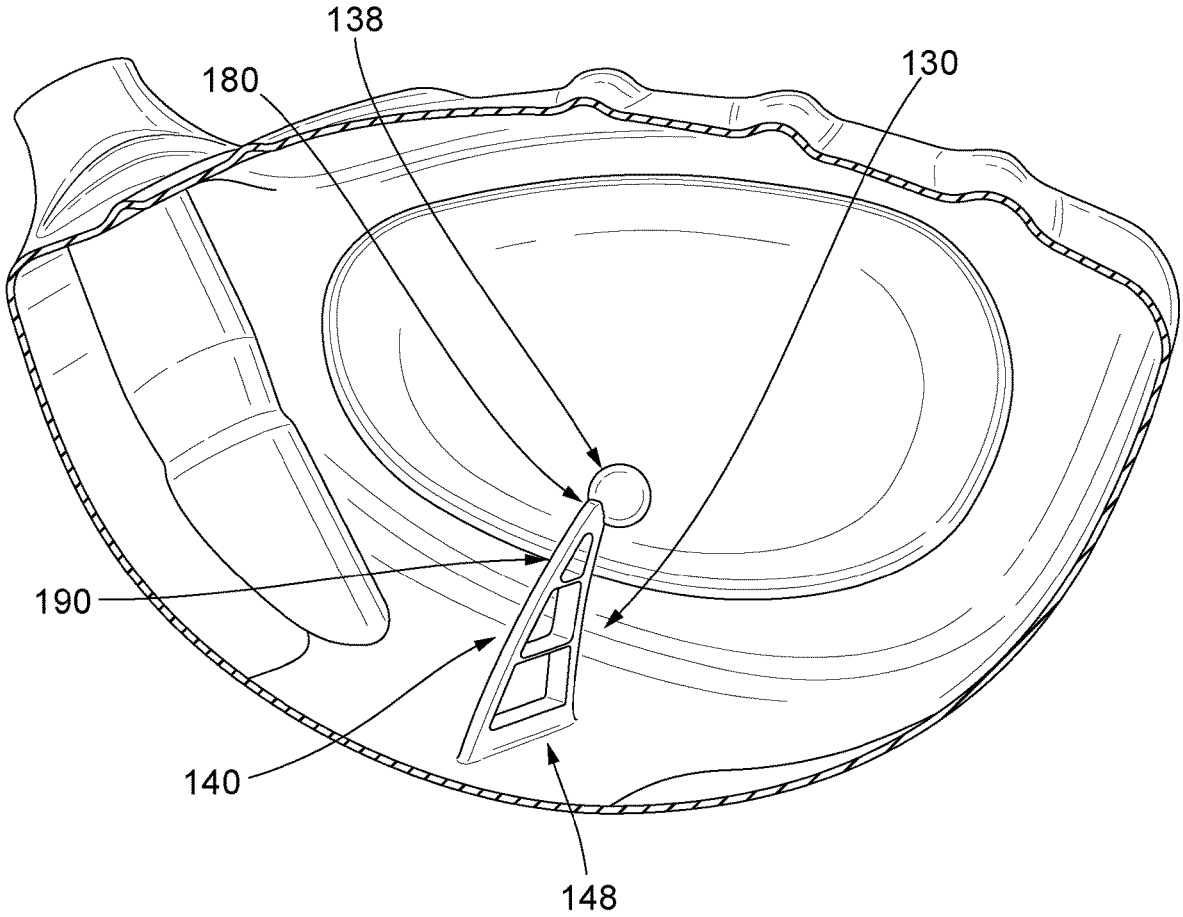
FIG. 8 illustrates a rear view, in cross-section rear, of the wood-type club head of FIG. 4.
Figure 9:
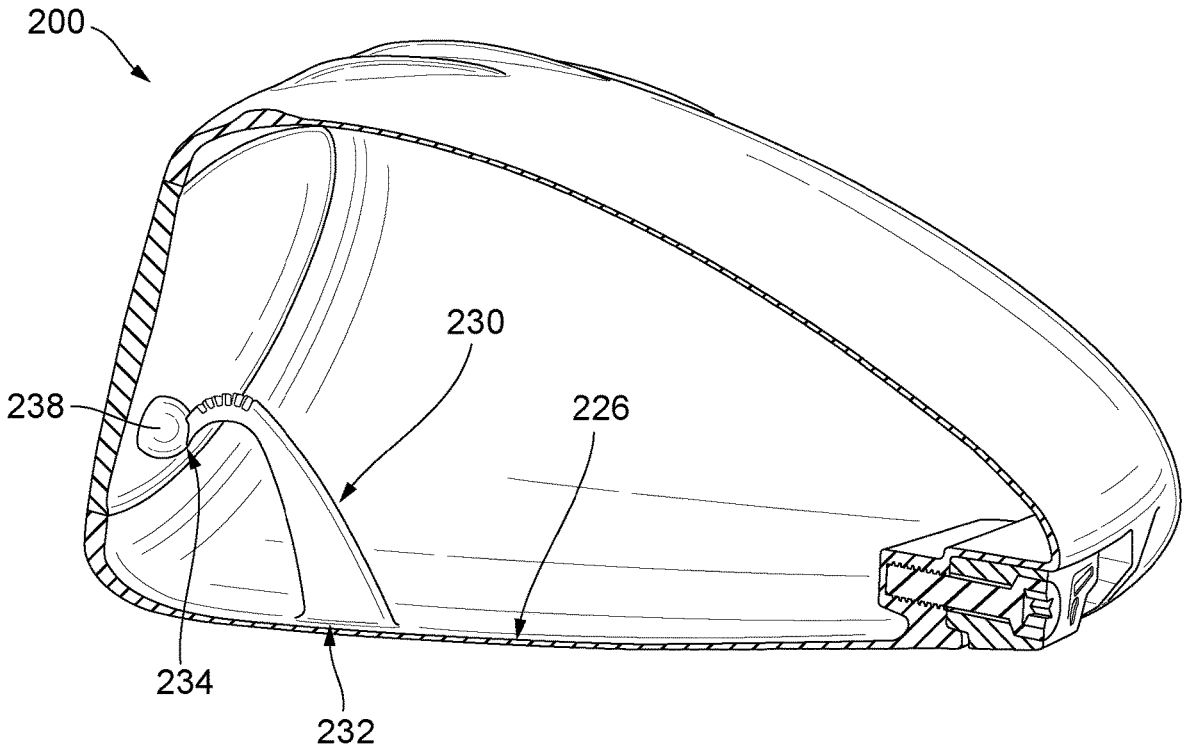
FIG. 9 illustrates a side view, in cross-section, of an embodiment of a wood-type golf club head with a moderated response.
Figure 10:
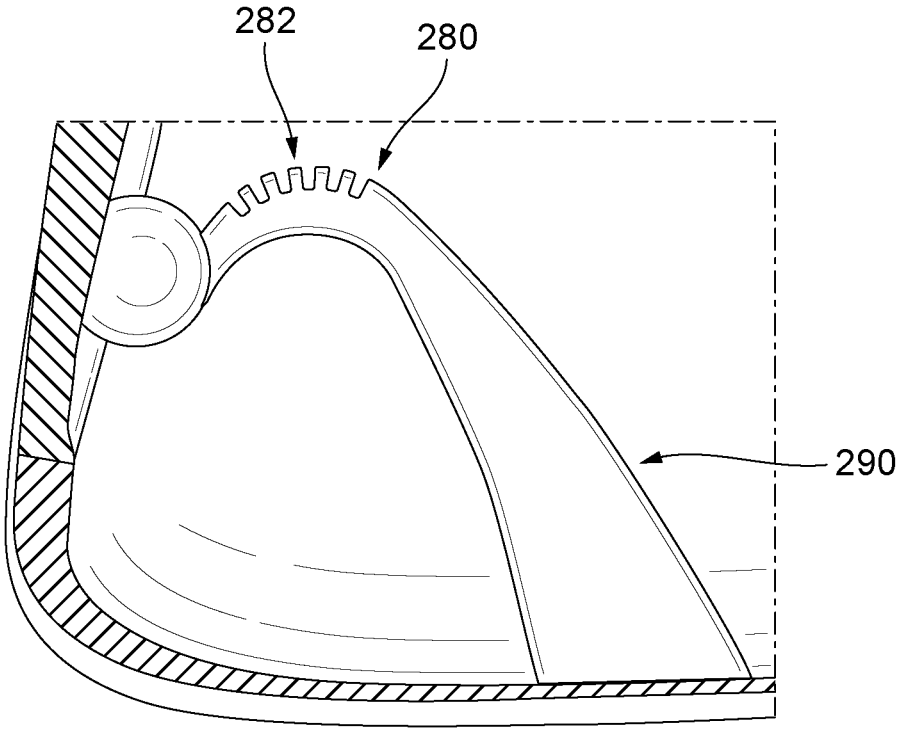
FIG. 10 illustrates an enlarged side view, in cross-section, of the wood-type club head of FIG. 9.
Figure 11:
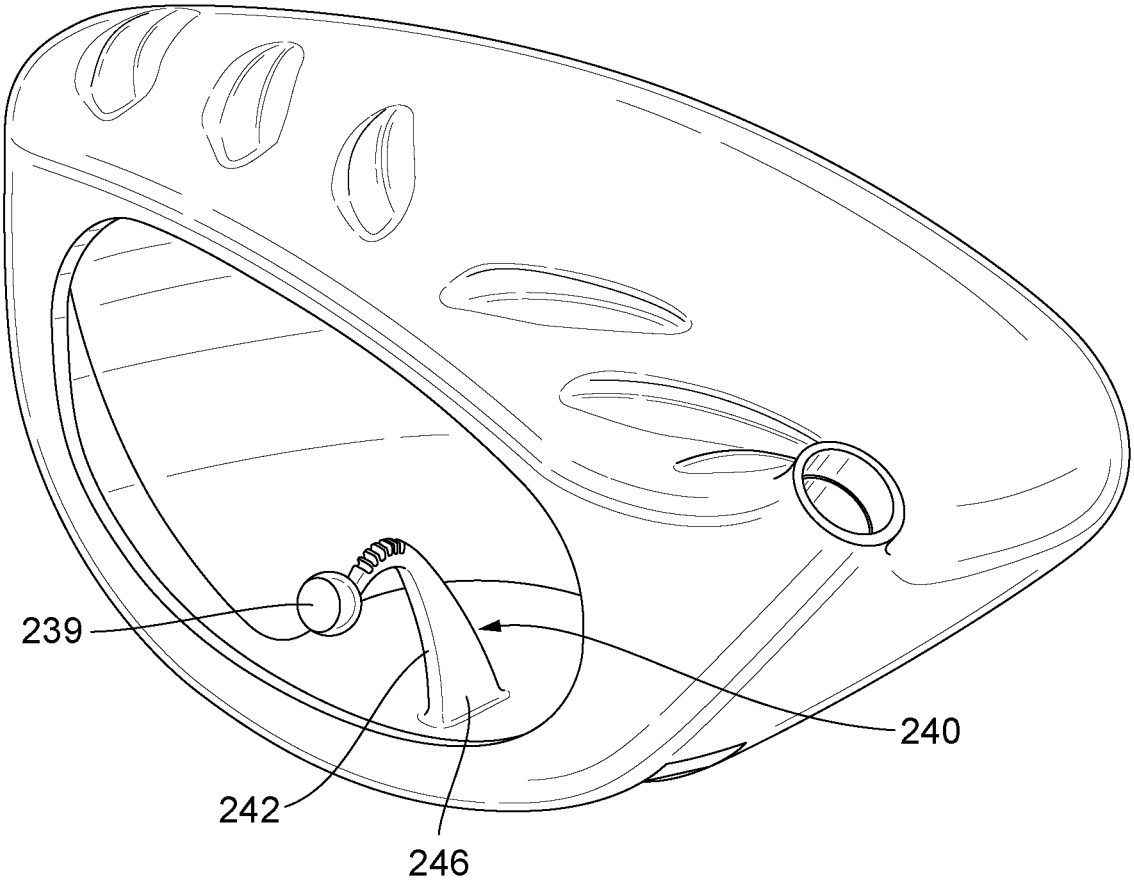
FIG. 11 illustrates a perspective view of the wood-type club head of FIG. 9, with a front portion removed to show an interior of the wood-type club head.
Figure 12:
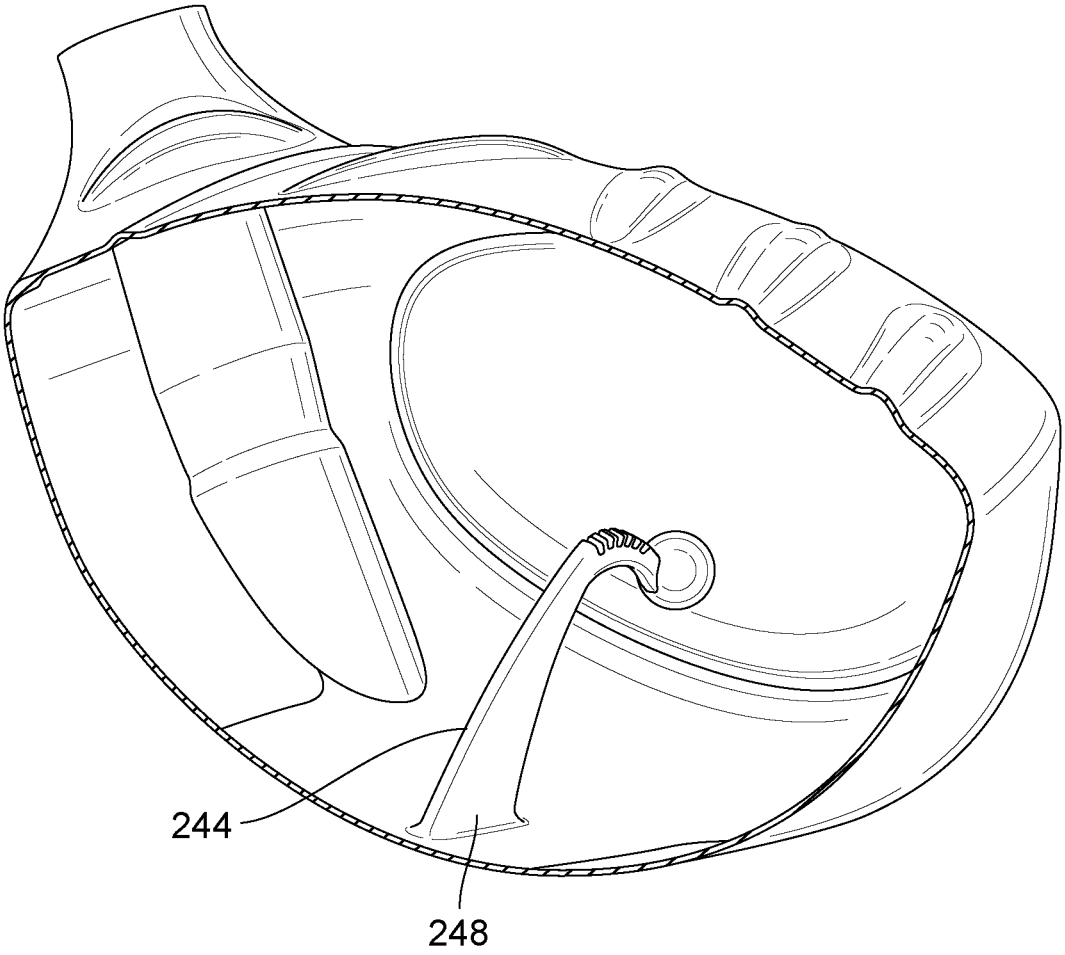
FIG. 12 illustrates a rear view, in cross-section, of the wood-type club head of FIG. 9.
Figure 13:
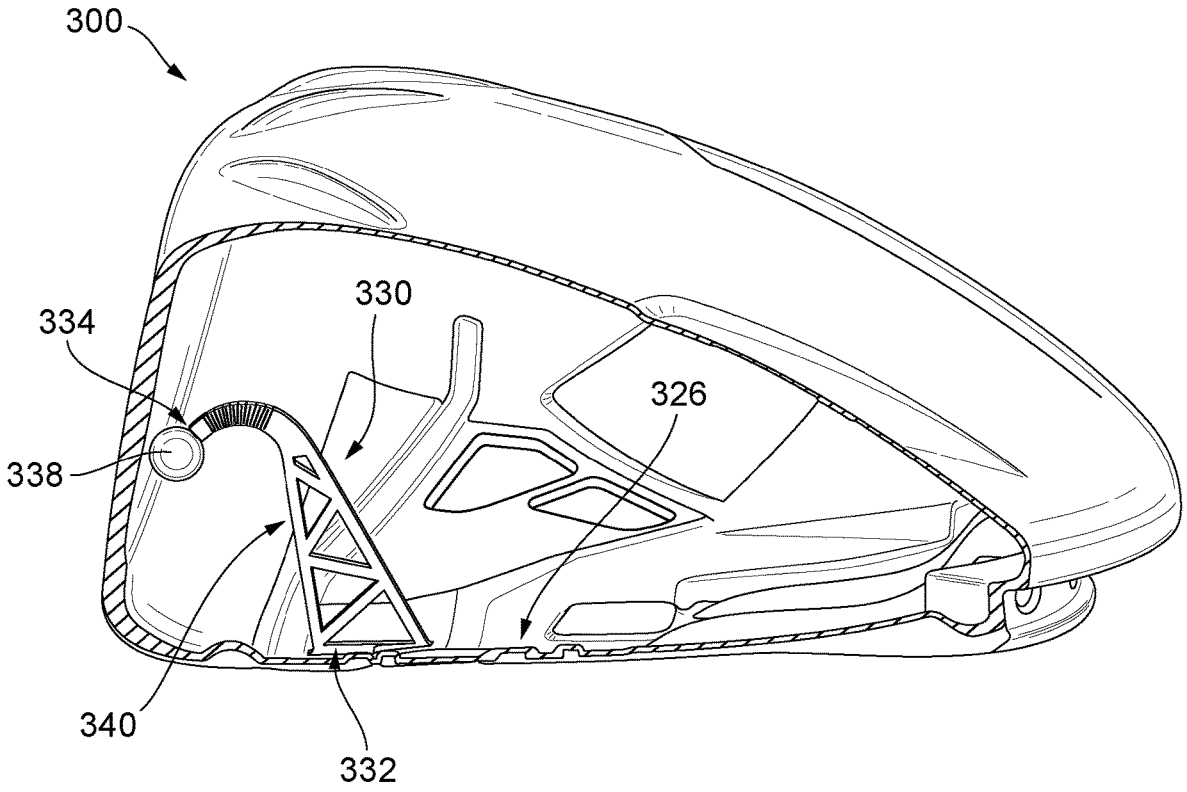
FIG. 13 illustrates a side view, in cross-section, of an embodiment of a wood-type golf club head with a moderated response.
Figure 14:
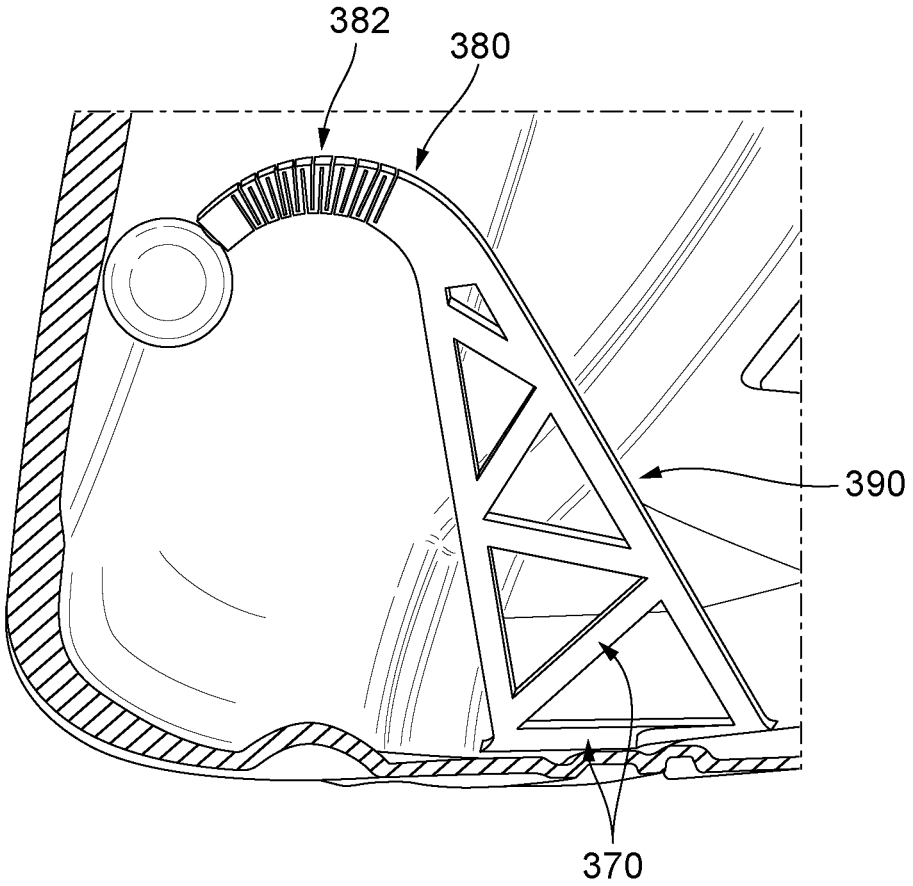
FIG. 14 illustrates an enlarged side view, in cross-section, of the wood-type club head of FIG. 13.
Figure 15:
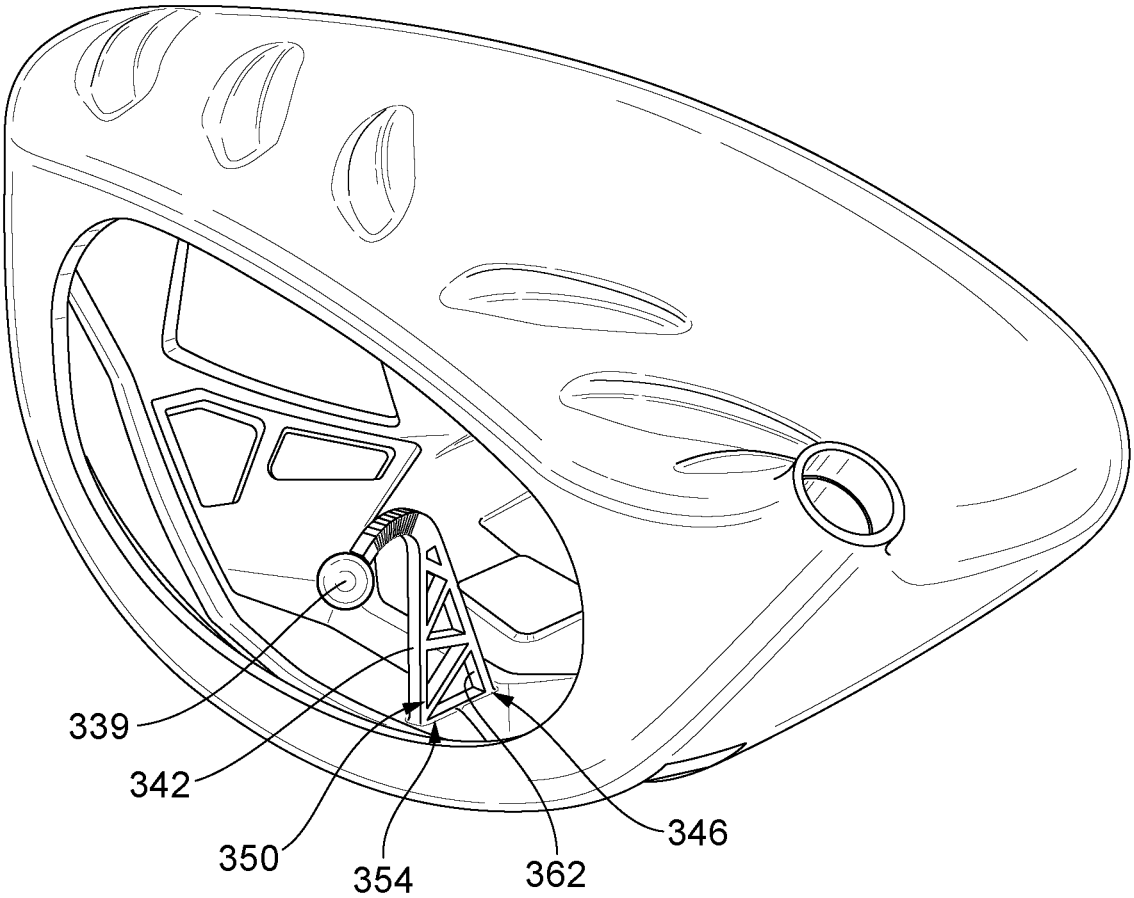
FIG. 15 illustrates a perspective view of the wood-type club head of FIG. 13, with a front portion removed to show an interior of the wood-type club head.
Figure 16:
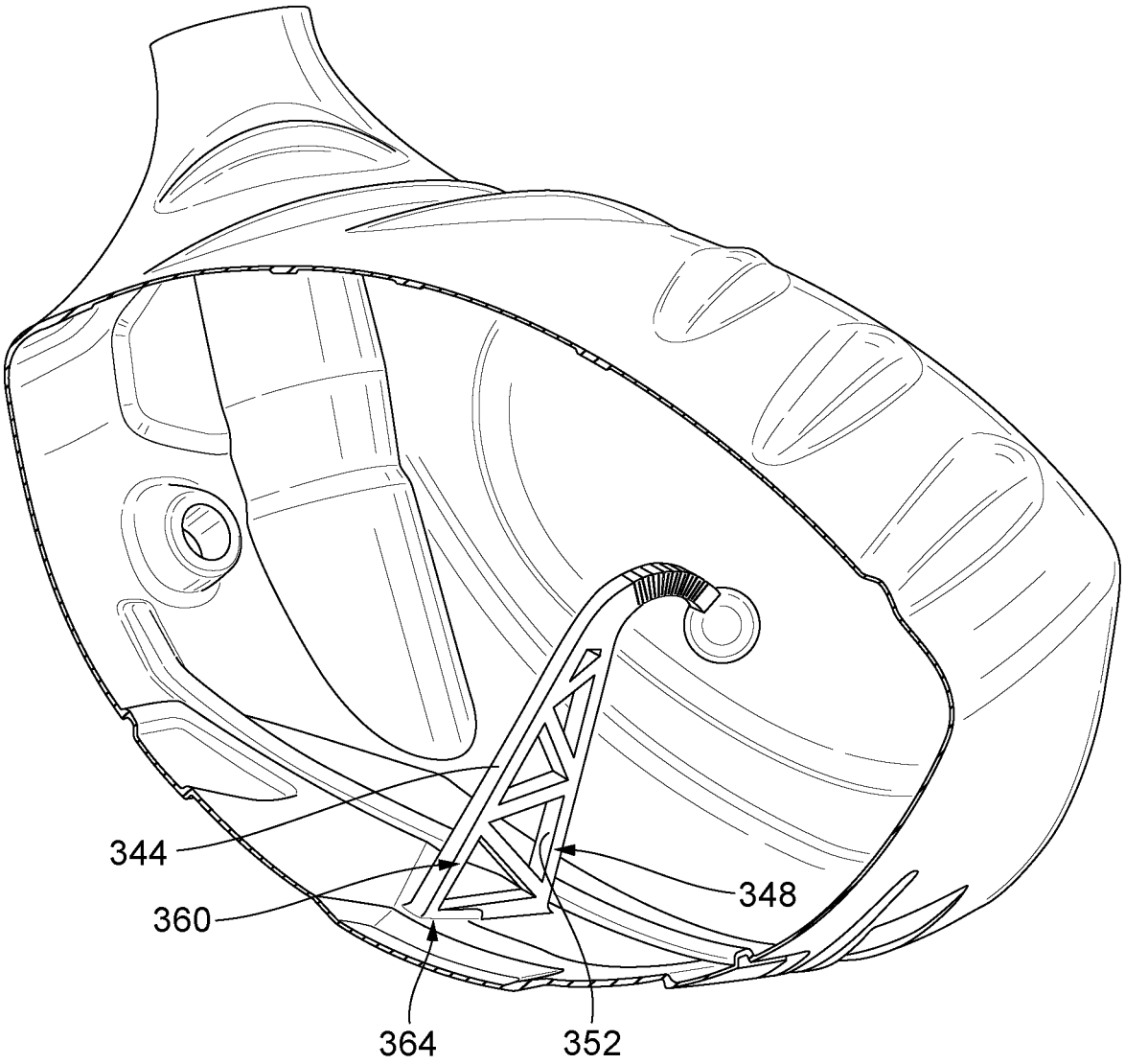
FIG. 16 illustrates a rear perspective view, in cross-section, of the wood-type club head of FIG. 13.

Referring to FIGS. 1-3, the wood-type golf club head 100 (hereafter alternately referred to as "the club head") comprising a resilient member. The club head 100 is depicted in various views. The general club head features as described herein exist in club head 100. Specifically, FIG. 1 illustrates a front perspective view of the club head 100. The club head 100 can comprise a strikeface 102 and a body 110, wherein the strikeface 102 and the body 110 are secured together to define a substantially closed/hollow interior cavity. The club head 100 can comprise a front portion and a rear portion. The club head can further comprise a crown 108, a sole 114 opposite the crown 108, a heel 104, a toe 106 opposite the heel 104, a front, and a rear opposite the front. The sole 114 can further comprise an internal surface 126 facing the internal cavity and an external surface opposite the internal surface 126. The body 110 can further include a skirt or trailing edge located between and adjoining the crown 108 and the sole 114, the skirt extending from near the heel 104 to near the toe 106 of the club head 100.

As discussed above, the strikeface 102 and the body 110 can define an internal cavity of the club head. The body 110 can extend over the crown 108, the sole 114, the heel 104, the toe 106, the rear, and a perimeter of the front. In these embodiments, the body 110 defines an opening in the front of the club head 100 and the strikeface 102 is positioned within the opening to form the club head 100. In some embodiments, (not shown) the strikeface extends over the perimeter of the front and can include a return portion extending rearward from the strikeface. The return portion can extend over at least one of the crown, the sole, the heel, and the toe. In embodiments comprising the return portion, the return portion of the strikeface is secured to the body to form the club head. In these embodiments, the club head can resemble a cup face or face wrap design.

The club head 100 can further comprise a hosel structure. The hosel structure is capable of receiving a hosel sleeve and a golf shaft, wherein the hosel sleeve can be coupled to an end of the golf shaft (not shown). The hosel sleeve can be coupled with the hosel structure in a plurality of configurations, thereby permitting the golf shaft to be secured to the hosel structure at a plurality of angles. In some embodiments, not shown, the hosel sleeve is not concealed within a tube portion of the hosel structure. Therefore, at least a portion of the hosel sleeve is exposed to the interior cavity meaning at least a portion of the shaft sleeve outer wall is exposed to the interior cavity. In some embodiments, the hosel sleeve can comprise an open hosel.

The club head 100 can further comprise a weight port 116 configured to receive a removable weight. In many embodiments, the weight port 116 can be located in the sole 114 and/or in the skirt. The club head 100 can also comprise a mass pad or weight pad (hereafter "mass pad"). In many embodiments, the mass pad can be located on the sole 114 and within the interior cavity. In some embodiments, the mass pad can be located on the sole 114 and skirt, and within the interior cavity. In some embodiments, still, the club head 100 can comprise one or more weight ports, and one or more mass pads. The removable weight 118 and mass pad can adjust the moment of inertia (MOI) properties and center of gravity (CG) location.

The addition of the resilient member can alter the bending of the club head during impact. This can allow for the removal of support structure such as ribs, saving discretionary mass that can then be redistributed throughout the club head. The additional discretionary mass can be used to improve various golf club head parameters, such as CG position, MOI, spin, durability, moderating and stabilizing CT across the strikeface, and managing stresses across the strikeface.

As discussed above, the club head can comprise a strikeface wherein the strikeface comprises a rear surface facing the internal cavity and a striking surface opposite the rear surface. As discussed in depth below, the rear surface can contact the resilient member. The strikeface further defines a thickness measured between the striking surface and the rear surface. The strikeface can comprise a variable thickness profile such that the strikeface comprises a strikeface max thickness and a strikeface min thickness. The addition of the resilient member in contact with the rear surface can normalize impact response by moderating and stabilizing CT across the strikeface allowing for the thinning of the strikeface and an improvement in ball speed. The addition of the resilient member can allow for the thinning of the strikeface, leading to up a 10% reduction in the strikeface max thickness and a 10% reduction in the strikeface min thickness.

II. RESILIENT MEMBER

The club head can comprise a resilient member. The resilient member normalizes impact response across the strikeface, thereby directly or indirectly improving other performance characteristics of the golf club head. The resilient member can extend up from the sole and curve towards the strikeface. The geometry, materials, and position of the resilient member can directly affect how the resilient member reacts at impact and therefore the impact response of the strikeface. Additionally, by normalizing impact response, the resilient member can improve durability allowing other components of the club head to be modified for improved performance, such as thinning the strikeface. In some embodiments, the resilient member can provide structural rigidity to the golf club head at rest and during low-energy impacts. In some embodiments, the resilient member can provide flexure during high-energy impacts.

A. Base

The resilient member can comprise a base and a contact member. The base can comprise a free end and a base end. In some embodiments, the base can be of a solid construction comprising a forward surface and a rearward surface. In some embodiments, the base can have a construction that forms a void. The base comprises a first arm, a second arm, and base end can form a void. The first arm can further comprise the forward surface and a first rearward surface and the second arm can further comprise a second forward surface and the rearward surface. The first rearward surface and the second forward surface provide attachment points for a plurality of support member, as discussed in depth below.

The forward surface and the rearward surface can be spaced a distance apart from each other at the base end. Additionally, the forward surface and the rearward surface can converge and connect at the free end. The free end can provide a connection point for the contact member. The geometry and placement of the resilient member and more specifically the geometry and placement of the forward surface and the rearward surface allows the contact member to be preloaded against the strikeface rear surface.

As discussed above, the base end can further define a forward most point and a rearward most point. The forward most point can correspond to the forward surface and the rearward most point can correspond to rearward surface. In such embodiments, the base can comprise a plurality of support members that extend between the first rearward surface and the second forward surface, as discussed below.

The base can be made of a single material or multiple materials including but not limited to, composites, titanium, aluminum, and steel. The base can be but is not limited to quasi-isotropic, unidirectional, or braided quasi-isotropic. The base can be but is not limited to laminate types such as symmetric, antisymmetric, or unsymmetric. The ply of the base can be but is not limited to cross-ply, angled ply, orthotropic, or anisotropic. The base material can be selected to ensure the resilient member is strong enough to withstand the transfer of energy placed upon it at impact but light enough to ensure the MOI and CG of the club head is not greatly affected.

The base can further comprise a base height. The base height can be defined as the distance from the ground plane to the topmost point of the base in a direction parallel to the y-axis. In some embodiments, the base height can be between 0.50 inches and 1.50 inches. In some embodiments, the base height can be between 0.50 inches and 0.60 inches, 0.60 inches and 0.70 inches, 0.70 inches and 0.80 inches, 0.80 inches and 0.90 inches, 0.90 inches and 1.00 inches, 1.00 inches and 1.10 inches, 1.10 inches and 1.20 inches, 1.20 inches and 1.30 inches, 1.30 inches and 1.40 inches, or 1.40 inches and 1.50 inches.

The base can further comprise a mass. The base mass can be between 0.50 grams and 3.00 grams. In some embodiments, the base mass can be between 0.50 grams and 0.75 grams, 0.75 grams and 1.00 grams, 1.00 grams and 1.25 grams, 1.25 grams and 1.50 grams, 1.50 grams and 1.75 grams, 1.75 grams and 2.00 grams, 2.00 grams and 2.25 grams, 2.25 grams and 2.50 grams, 2.50 grams and 2.75 grams, 2.75 grams and 3.00 grams. As previously mentioned, it can be advantages to keep the base mass as low as possible without sacrificing durability.

a. Base End

More specifically, the base can extend from the sole upwards and forwards in an arcuate manner from the base end to the free end. The base end can provide a connection point between the resilient member and the sole. In some embodiments, the resilient member base can be cast with the club head body. In some embodiments, the resilient member base can be formed as a separate piece that is subsequently coupled to the body. In such embodiments the resilient member base can be cast separately from the body and secured to the sole by various connection means. The connection means can be selected from the group consisting of plasma welding, laser welding, adhesive, brazing, and any suitable mechanical attachment means.

A distance can be defined between the forward most point of the base and the rearward most point of the base. The distance between the forward most point and the rearward most point can define a base end depth. In some embodiments, the base end depth can be between 0.25 inches and 1.00 inches. In some embodiments, the base end depth can be between 0.25 inches and 0.40 inches, 0.40 inches and 0.55 inches, 0.55 inches and 0.70 inches, 0.70 inches and 0.85 inches, or 0.85 inches and 1.00 inches. The base end depth can influence the stability of the resilient member, as a larger base end depth translates to a more stable and therefore durable resilient member.

The distance between the forward surface and the rearward surface can be defined as a surface distance. The surface distance can be measured in a direction parallel to the z-axis. The surface distance can be greatest at the base. The surface distance can be variable such that it decreases towards the strikeface rear surface. The surface distance can decrease until the forward surface and the rearward surface join to form the free end. The maximum surface distance can be substantially the same as the base end depth.

A location at which the resilient member is attached to the sole relative to the strikeface can affect the pre-load force placed on the strikeface prior to impact, as well as how the resilient member responds at impact. A forward base distance can be defined as the distance from the forward most point of the base end to the loft plane in a direction parallel to the z-axis. In some embodiments, the forward base distance can be between 0.25 inches and 4.00 inches. In some embodiments, the forward base distance can be between 0.25 inches and 0.50 inches, 0.50 inches and 0.75 inches, 0.75 inches and 1.00 inches, 1.00 inches and 1.25 inches, 1.25 inches and 1.50 inches, 1.50 inches and 1.75 inches, 1.75 inches and 2.00 inches, 2.00 inches and 2.25 inches, 2.25 inches and 2.50 inches, 2.50 inches and 2.75 inches, 2.75 inches and 3.00 inches, 3.00 inches and 3.25 inches, 3.25 inches and 3.50 inches, 3.50 inches and 3.75 inches, or 3.75 inches and 4.00 inches. In one exemplary embodiment the forward base distance is 0.64 inches.

Further, a rear base distance can be defined as the distance from the rearward most point of the base end to the loft plane in a direction parallel to the z-axis. In some embodiments, the rear base distance can be between 0.50 inches and 5.00 inches. In some embodiments, the rear base distance can be between 0.50 inches and 0.75 inches, 0.75 inches and 1.00 inches, 1.00 inches and 1.25 inches, 1.25 inches and 1.50 inches, 1.50 inches and 1.75 inches, 1.75 inches and 2.00 inches, 2.00 inches and 2.25 inches, 2.25 inches and 2.50 inches, 2.50 inches and 2.75 inches, 2.75 inches and 3.00 inches, 3.00 inches and 3.25 inches, 3.25 inches and 3.50 inches, 3.50 inches and 3.75 inches, or 3.75 inches and 4.00 inches, 4.00 inches and 4.25 inches, 4.25 inches and 4.50 inches, 4.50 inches and 4.75 inches, or 4.75 inches and 4.00 inches In one exemplary embodiment the rear base distance is 1.225 inches. As previously mentioned, the position of the resilient member on the sole relative to the strikeface along with the curvature of the base can impact the pre-load force and impact response of the resilient member.

The base can further comprise a base heel side and a base toe side, where the base heel side is the side proximate the heel and the base toe side is side proximate the toe. In some embodiments, the base heel side and base toe side are parallel allowing for easy manufacturing and the necessary durability throughout the entirety of the base.

The base can further define a base thickness. The base thickness can be defined as the distance between the base toe side and the base heel side in a direction parallel to the x-axis. In some embodiments, the base thickness can be between 0.025 inches and 1.025 inches. In some embodiments, the base thickness can be between 0.025 inches and 0.125, 0.125 inches and 0.225 inches, 0.225 inches and 0.325 inches, 0.325 inches and 0.425 inches, 0.425 inches and 0.525 inches, 0.525 inches and 0.625 inches, 0.625 inches and 0.725 inches, 0.725 inches and 0.825 inches, 0.825 inches and 0.925 inches, or 0.925 inches and 1.025 inches. The base thickness can be thick enough to ensure durability, but thin enough to avoid unnecessary mass. In some embodiments, the base thickness can be variable. In some embodiments, the base thickness can be constant.

The base can define a base end area, wherein the base end area is the surface area the sole 114 the base end contacts. In some embodiments, the base end area can be between 0.025 $in^2$ and 1.025 $in^2$. In some embodiments, the base end area can be between 0.025 $in^2$ and 0.125 $in^2$, 0.125 $in^2$ and 0.225 $in^2$, 0.225 $in^2$ and 0.325 $in^2$, 0.325 $in^2$ and 0.425 $in^2$, 0.425 $in^2$ and 0.525 $in^2$, 0.525 $in^2$ and 0.625 $in^2$, 0.625 $in^2$ and 0.725 $in^2$, 0.725 $in^2$ and 0.825 $in^2$, 0.825 $in^2$ and 0.925 $in^2$, or 0.925 $in^2$ and 1.025 $in^2$. The base end area is dependent on the base end depth and the thickness at the base end. The base end area is large enough to ensure durability without adding unneeded mass. A base end area that is too small could lead to failures and a base end area that is too large adds unnecessary mass, potentially shifting the CG towards the strikeface.

b. Relatively Rigid Section

The base can further comprise a relatively rigid section extending from the base end to an intermediate section. The intermediate section can extend from the relatively rigid section in a curved manner towards the strikeface. In some embodiments, the intermediate section extends from the relatively rigid section to the free end. In such embodiments the base can act as a rigid structure with little to no give. In some embodiments, the intermediate section can further comprise a flexure zone, wherein the flexure zone extends from the intermediate section to the free end. In such embodiments the base can act as a flexible structure.

The resilient member, and more specifically the base, can have a shape that supports the contact member in position against the rear surface of the strikeface. In some embodiments, the base has an arcuate shape that extends from the sole upwards and forwards from the base end to the free end. The relatively rigid section can extend from the base end in a relatively constant manner. The forward surface and the rearward surface of the relatively rigid section can extend in a linear manner from the base end to the intermediate section. The forward surface and the rearward surface of the relatively rigid section are parallel.

In some embodiments, the relatively rigid section can extend with a constant radius. The relatively rigid section can comprise a constant curve such that the radius of the forward surface (hereafter the first rigid radius) and the radius of the rearward edge (hereafter the second rigid radius) within the intermediate section remains constant. The relatively rigid section can comprise multiple sections with different radii. For example, the rigid section can comprise at least a first rigid radius and a second rigid radius. The relatively rigid section comprises a variable curve, wherein the first rigid radius and the second rigid radius increases as the intermediate sections extends from the relatively rigid section towards the strikeface.

The resilient member, and more specifically the relatively rigid section, further can comprise a base first angle and a base second angle. The base first angle can be defined as the angle between the ground plane and a first base axis, wherein the first base axis is tangent the base forward surface at the point where the base forward surface contacts the sole 114. In some embodiments, the base first angle can be between 45 degrees and 85 degrees. In some embodiments, the base first angle can be between 45 degrees and 50 degrees, 50 degrees and 55 degrees, 55 degrees and 60 degrees, 60 degrees and 65 degrees, 65 degrees and 70 degrees, 70 degrees and 75 degrees, 75 degrees and 80 degrees, or 80 degrees and 85 degrees. In one exemplary embodiment the base first angle is 80 degrees. The base first angle can affect the stability of the resilient member and therefore more importantly the durability. Further the base angle as well as base end depth can affect how the resilient member bends as the impact force is transferred from the strikeface to the resilient member and then back to the strikeface.

The base second angle can be defined as the angle between the ground plane and a second base axis, wherein the second base axis is tangent the base rear surface at the point where the rear surface contacts the sole. The base second angle can be between 30 degrees and 70 degrees. The base first angle can be between 30 degrees and 35 degrees, 35 degrees and 40 degrees, 40 degrees and 45 degrees, 45 degrees and 50 degrees, 50 degrees and 55 degrees, 55 degrees and 60 degrees, 60 degrees and 65 degrees, or 65 degrees and 70 degrees. In one exemplary embodiment, the base second angle is 60 degrees. The base second angle can be less than the base first angle. A base angle that falls outside the desired range could lead to the failure of the resilient member at the base end.

i. Support Members

The geometry of the resilient member can affect the reaction of the strikeface at impact. In some embodiments, the base can be of a solid construction. In some embodiments, the base can have a construction with a void. In such embodiments, the first arm, second arm, and the base end form a void. The first arm can comprise the forward surface that can be oriented substantially towards the front of the club head, a first rearward surface can be oriented substantially towards the rear of the club head, and a first base end that can be coupled to the internal surface of the sole. The second arm can comprise the second forward surface that can be oriented substantially towards the front of the club head, the rearward surface that can be oriented substantially towards the rear of the club head, and the second base end that can be coupled to the internal surface of the sole. A plurality of support members can extend from the first rearward surface to the second rearward surface to form a truss like structure. The first arm and the second arm can form the truss like structure, ensures the durability of resilient member without adding unnecessary mass.

The support members can be configured to reduce the overall mass of the resilient member while still sufficiently supporting the contact member. In some embodiments, the plurality of support members can comprise between 2 support members and 8 support members. In some embodiments, the plurality of support members can comprise 2 support members, 3 support members, 4 support members, 5 support members, 6 support members, 7 support members, or 8 support members.

In some embodiments, the plurality of support members can be parallel to each other. In some embodiments, some of the plurality of support members can converge at a point along the base first rearward surface or at a point along the base second forward surface. At least 2 support members of the plurality of support members can converge at a point along the base first rearward surface and at least 2 support members of the plurality of support members can converge at a point along the base second forward surface. This can form the truss like structure, ensures the durability of resilient member without adding unnecessary mass.

c. Intermediate Section

The intermediate section can extend in a generally arcuate shape from the relatively rigid section toward the strikeface to the free end. In some embodiments, the intermediate section can comprise a constant curve, such that the radius of the base forward surface (hereafter the first intermediate radius) and the radius of the base rearward surface (hereafter the second intermediate radius) within the intermediate section remains constant. The intermediate section can comprise a variable curve such that the first intermediate radius and second intermediate radius is variable. The intermediate section comprises a variable curve, wherein the first intermediate radius and the second intermediate radius increases as the intermediate sections extends from the relatively rigid section towards the strikeface. The variable curve can comprise the first intermediate radius and the second intermediate radius decreases as the intermediate section extends from the relatively rigid section towards the strikeface. The intermediate section curves from the relatively rigid section providing a section of the resilient member that flexes or springs at impact.

i. Flexure Zone

In some embodiments, the intermediate section can further comprise a flexure zone. The flexure zone can allow the resilient member to flex more during impact as compared to a resilient member without a flexure zone. The flexure zone can comprise a spring like member. The flexure member can comprise a plurality of recesses formed in the intermediate section. The plurality of recesses can form a teethlike structure. The plurality of recesses can be positioned on the base forward most surface, the base rearward most surface, the base heel side, the base toe side, or any combinations thereof. The flexure zone can comprise a spring-link member. The flexure zone can allow for an increased deformation of the resilient member. The increase deformation can allow the resilient member to act as a spring, absorbing energy from the golf ball, to assume a deflected state. The resilient member subsequently transfers the absorbed energy back into the golf ball while returning to the initial undeflected state.

d. Free End

As discussed above, the forward surface and the rearward surface can connect at the free end. The free end can act as a connection point between the contact member and the base. The free end can comprise a geometry compatible with the contact member. The free end can further comprise a post, wherein the post can extend away from the base.

The post can comprise a post shape. The post shape can be defined as the shape of the cross section of the post. The post shape can be selected from a ground consisting of an oval, a square, a reactance, a circle, a diamond, a parallelogram, and any other acceptable shape. In one exemplary embodiment the post shape is a rectangular shape with fileted corners.

In some embodiments, the post can comprise a receiving geometry. The receiving geometry can act as a means of connecting and securing the contact member to the post. The entirety of the post is positioned within the contact member. The majority of the post is positioned within the contact member. The post can receive a portion of the contact member. The position of the post within the contact member provides support to the contact member.

The contact member can be secured to the post through a variety of means. In one embodiment, the contact member can be cast to the post. The post can comprise receiving geometry and the contact member can comprise a corresponding geometry. The contact member can be exposed to the post. The contact member can be press-fit to the post. The contact member can comprise a threaded extension that is screwed into a threaded recess of the post. These geometries ensures the contact member remains securely connected to the post during the manufacturing process and through the life of the club head.

The post can further comprise a post depth. The post depth can be defined as the linear distance the post extending past a contact member surface. In some embodiments, the post depth can be between 0.050 inches and 0.150 inches. The post depth can be between 0.050 inches and 0.075 inches, 0.075 inches and 0.100 inches, or 0.125 inches and 0.150 inches. A post depth that is too small (i.e. less than 0.050 inches) ensures the resilient member acts solely as a damper as the energy produced at impact is transferred solely to the contact member and is not translated to the base. A post that is too large (i.e. greater than 0.150 inches) can yield issues in durability as there would not be enough contact member between the strikeface rear surface and the post, potentially leading to the failure of the contact member. Further, a post that is too large can include unnecessary mass. A post depth in the aforementioned range ensures the energy is transferred from the strike to the contact member into the base then back to the strikeface. This energy transfer can normalize impact response by moderating and stabilizing CT across the strikeface allowing for the thinning of the strikeface and an improvement in ball speed.

The face can further comprise a centroid defined as the center point of the end of the post. The free end can further comprise a free end height. The free end can be defined as the distance from the ground plane to a free end centroid in a direction parallel to the y-axis. The free end height can be between 0.25 inches and 2.00 inches. In some embodiments, the free end height can be between 0.25 inches and 0.50 inches, 0.50 inches and 0.75 inches, 0.75 inches and 1.00 inches, 1.00 inches and 1.25 inches, 1.25 inches and 1.50 inches, 1.50 inches and 1.75 inches, or 1.75 inches and 2.00 inches. The free end height can dictate the placement of the contact member on the strikeface rear surface, impacting the reinforcement member ability to normalize the reaction of the strikeface.

B. Contact Member

The contact member can be coupled to the free end and can be formed of a deformable material. The contact member continuously engages the rear surface of the strikeface to apply the pre-load force and post impact force on the strikeface. The pre-load force of resilient member presses the contact member into the strikeface, a front portion of the contact member deforms to form a contact surface. At impact, the contact member may further deform to absorb energy from the strikeface. The material used throughout the resilient member, as well as the geometry and position can determine how the resilient member reacts during impact. The contact member material and location of engagement on the strikeface can be selected to normalize impact response of hot spots on the strikeface to ensure the conformance and durability of a clubhead while improving performance factors such as ball speed and distance.

Figure 18A:
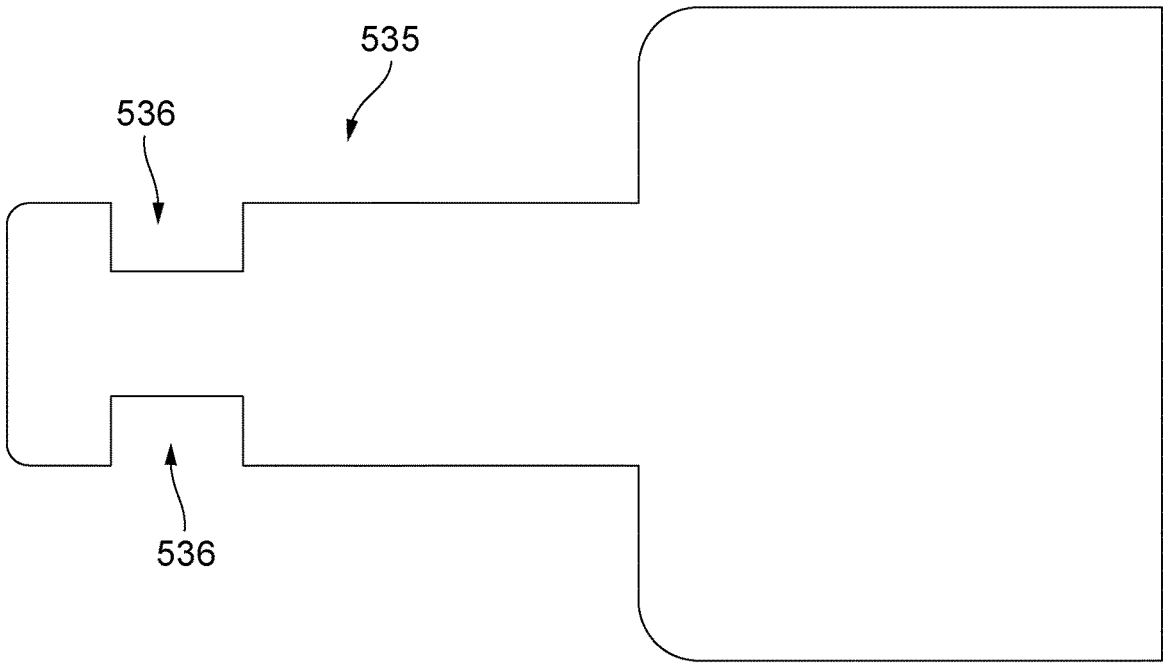
FIG. 18A illustrates an enlarged side view, in cross-section, of a component of a moderated response.
Figure 18B:
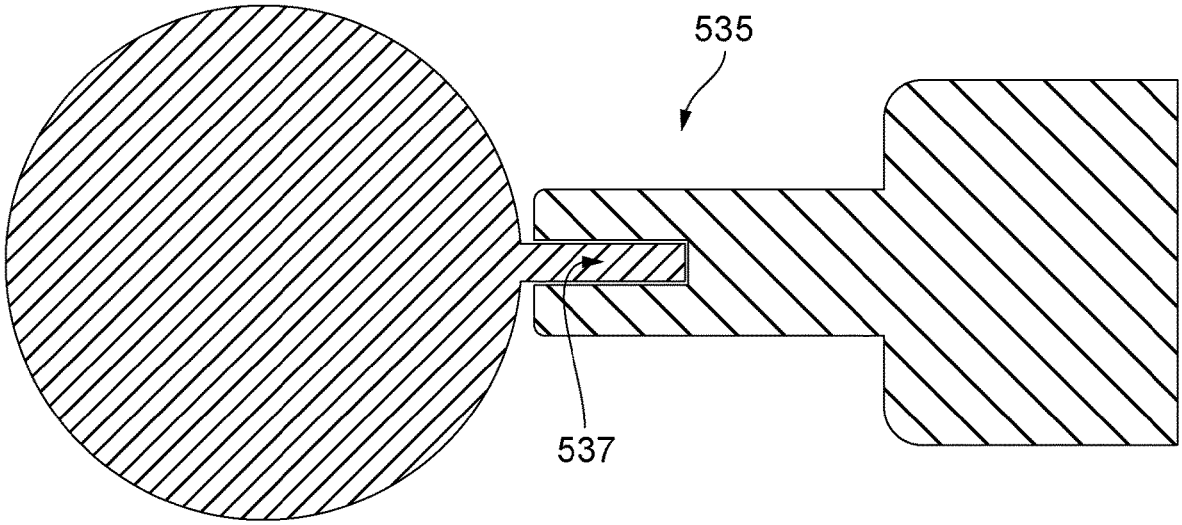
FIG. 18B illustrates an enlarged side view, in cross-section, of a component of a moderated response.

The contact member and free end can have complementary geometries that can allow the components to mechanically couple similar to that depicted in FIG. 18A. The contact member can be secured to the post 535 through a variety of means. In one embodiment, the contact member can be cast to the post 535. The post 535 can comprise a receiving geometry 536 and the contact member can comprise a corresponding geometry 537. The contact member can comprise a female mating geometry and the base can comprise a male mating geometry. Similar to that of FIG. 18B, the contact member can comprise a male mating geometry and the base can comprise a female mating geometry. The geometry of the components can allow the contact member to be adhesively attached, coupled by mechanical means or a combination of both.

The contact member can be positioned to engage a region of the strikeface that reduces impact response across the strikeface while refraining from diminishing resulting ball speed. For example, the contact member can contact the rear surface of the strikeface within a region that is offset from the geometric center. It is important to place the contact member at a point along the strikeface that would not negatively impact ball speed.

In some embodiments, the placement of the contact member can be defined as a radial distance from the center of a contact member to the geometric centerpoint in a direction parallel to the loft plane. The radial distance can be between 0.10 inches and 0.80 inches. The radial distance can be between 0.10 inches and 0.20 inches, 0.20 inches and 0.30 inches, 0.30 inches and 0.40 inches, 0.40 inches and 0.50 inches, 0.50inches and 0.60 inches, 0.60 inches and 0.70 inches, or 0.70 inches and 0.80 inches. The placement of the contact member can directly impact the effect the resilient member has on normalizing of the strikeface response at impact. In some embodiments, the resilient member can be positioned on the sole toward of the z-axis. In some embodiments, the resilient member can be positioned on the sole heelward of the z-axis.

In some embodiments, the placement of the contact member on the strikeface relative to the CG can be defined as a CG distance. The CG distance can be defined as the distance from the center of a contact member, as discussed below, to the CG. The CG distance can be between 1.50 inches and 2.50 inches. The CG distance can be between 1.75 inches and 1.85 inches, 1.75 inches and 1.85 inches, 1.75 inches and 1.85 inches, 1.85 inches and 1.95 inches, 1.95 inches and 2.05 inches, 2.05 inches and 2.15 inches, 2.15 inches and 2.25 inches. A CG distance in the aforementioned range ensures the CG remain in the low rearward portion of the club head, yielding desirable ball flight.

As previously mentioned, the resilient member and more specifically the contact member can place a load on the strikeface rear surface at rest. The external shape of the contact member can be, but is not limited to, spherical, conical, frustoconical, cubical, pyramidal, tetrahedral, cylindrical, or prismatic. The contact member can deform when preloaded on the strikeface and then can further deform during impact.

The load the resilient member places of the strikeface rear can cause a slight deformation of the contact member when the club head is at rest. The deformation can create the contact surface. The contact surface can comprise a contact surface area that is in contact with the strikeface rear at rest. The contact surface area can be between 0.01 $in^2$ and 1.01 $in^2$. The contact surface area can be between 0.01 $in^2$ and 0.11 $in^2$, 0.11 $in^2$ and 0.21 $in^2$, 0.21 $in^2$ and 0.31 $in^2$, 0.31 $in^2$ and 0.41 $in^2$, 0.41 $in^2$ and 0.51 $in^2$, 0.51 $in^2$ and 0.51 $in^2$, 0.51 $in^2$ and 0.61 $in^2$, 0.61 $in^2$ and 0.71 $in^2$, 0.71 $in^2$ and 0.81 $in^2$, 0.81 $in^2$ and 0.91 $in^2$, or 0.91 $in^2$ and 1.01 $in^2$.

The contact member can further apply a force to the strikeface thought the duration of impact. As discussed in depth below in Example 3, the amount of force and the time the peak force is applied can vary on the geometry of both the resilient member base and the contact member. The peak force the contact member applies to the strikeface during impact can be between 20 lbf and 90 lbf. In some embodiments, the peak force can be between 20 lbf and 25 lbf, 25 lbf and 30 lbf, 30 lbf and 35 lbf, 35 lbf and 40 lbf, 40 lbf and 45 lbf, 45 lbf and 50 lbf, 50 lbf and 55 lbf, 55 lbf and 60 lbf, 60 lbf and 65 lbf, 65 lbf and 70 lbf, 70 lbf and 75 lbf, 75 lbf and 80 lbf, 80 lbf and 85 lbf, or 85 lbf and 90 lbf. The contact member can apply the peak force at peak impact. The contact member can apply the peak force before peak impact. The contact member can apply the peak force after peak impact.

The contact member can be made from, but is not limited to, a natural rubber, a synthetic rubber such as polybutadiene, a flexible TPE material, and other suitable materials or polymers in the hardness ranges discussed below. The contact member material can be selected to ensure the contact member has the ability to partially deform, is strong enough to withstand the transfer of energy placed upon it at impact, and light enough to ensure the MOI and CG of the club head is not greatly affected.

The contact member can further comprise a mass. The contact member mass can be between 0.005 grams and 5.000 grams. In some embodiments, the base mass can be between 0.005 grams and 0.255 grams, 0.255 grams and 0.505 grams, 0.755 grams and 1.005 grams, 1.005 grams and 1.255 grams, 1.255 grams and 1.505 grams, 1.755 grams and 2.005 grams, 2.005 grams and 2.255 grams, 2.255 grams and 2.505 grams, 2.755 grams and 3.005 grams, 3.005 grams and 3.255 grams, 3.255 grams and 3.505 grams, 3.755 grams and 4.005 grams, 4.005 grams and 4.255 grams, 4.255 grams and 4.505 grams, or 4.755 grams and 5.005 grams.

The contact member can be formed of a material that allows the contact member to partially deform. As described above, the contact member can continuously contact the rear surface of the strikeface. Thus, it is important for the contact member to be made from a material that can deform as the strikeface deflects when impacted and then return to its original shape post impact. The contact member can be made of a material that has a Shore A hardness between 45 A to 100 A. The contact member can be made from a material with a Shore A hardness greater than 45 A, 50 A, 55 A, 60 A, 65 A, 70 A, 75 A, 80 A, 85 A, 90 A, 95 A, or 100 A. The contact member can be made from a material with a Shore A hardness between 45A to 50A, 50A to 55A, 55A to 60A, 60A to 65 A, 65 A to 70 A, 70 A to 75 A, 75 A to 80 A, 80 A to 85 A, 85 A to 90 A, 90 A to 95 A, or 95 A to 100 A. The contact member can be made of a material that has a Shore D hardness less than 65 D. The contact member 156 has a Shore D hardness of up to 10 D, 15 D, 20 D, 25 D, 30 D, 35 D, 40 D, 45 D, 50 D, 55 D, 60 D, or 65 D. The contact member has a Shore D hardness between 10 D to 15 D, 15 D to 20D, 20 D to 25 D, 25 D to 30 D, 30 D to 35 D, 35 D to 40D, 40 D to 45 D, 45 D to 50 D, 50 D to 55 D, 55 D to 60 D, or 60 D to 65 D. The hardness can be selected to allow the contact member to partially deform and then transfer the energy to the base. A hardness that is too hard can yield a contact member that does not deform and places more stress on the post, potentially leading to failure. A hardness that is too soft yields a contact member that deforms too much potentially leading to issues in durability.

In some embodiments, the contact member can be made of a material that had a Shore A hardness between 20 A and 50 A. In these embodiments, the softer material does not transfer as much energy from the strikeface to the contact member to the base. The contact member absorbs a substantial amount of the energy, making the resilient member behave in a matter to damp vibrations and sound of the club head opposed to adding resistance to the strikeface 102 at impact.

C. First Embodiment

In a further embodiment illustrated at FIGS. 4A-8, a golf club head 100 can comprise a resilient member 130 with a parallel truss like structure. The truss like structure ensures high durability without adding unnecessary mass while mandating and stabilizing CT across the strikeface.

The resilient 130 member can comprise a contact member 138 and a base 140. The resilient member 130 can be coupled to the sole internal surface 126 and extend upward in an accurate manner from the base end 132 to the free end 134. The base 140 can have a construction with a void, that a first arm 150, a second arm 160, and a base end 132 form a void. The first arm 150 can further comprise the forward surface 142 and a first rearward surface 152 and the second arm 160 can further comprise a second forward surface 162 and the rearward surface 144.

The forward surface 142 and rearward surface 144 can coverage and connect at the free end 134. The base 140 further comprises a base heel side 146 and a base toe side 148 wherein the base heel side 146 and base toe side 148 are parallel.

The base 140 can further comprise a relatively rigid section 190 extending from the base end 132 to an intermediate section 180. The relatively rigid section 190 can comprise a plurality of support members 170 that can extend from the first rearward surface 152 to the second forward surface 162 to form a truss like structure. The plurality of support members 170 can be positioned such that 2 members of the plurality of support members 170 converge at a point along the base first rearward surface 152 and 2 members of the plurality of support members 170 converge at a point along the base second forward surface 162. The void and truss like structure within the relatively rigid section 190 ensures the durability of resilient member 130 without adding unnecessary mass.

The intermediate section 180 can extend from the relatively rigid section 190 in a curved manner towards the strikeface 102 to the free end 134. The free end 134 can further comprise a post 135 wherein the post 135 can comprise a receiving geometry 136 configured to receive a portion of the contact member 138. Similar to the previously described embodiment, the contact member 138 can be made from a material that allows the resilient member 130 to have spring like forces under high energy impact to allow the strikeface 102 to deflect. The contact member 138 comprises a complementary geometry 137 to the receiving geometry 136. The contact member 138 can comprise an external shape the external shape can be spherical. At rest the contact member 138 can be in constant contact with the strikeface rear surface 128 such that the contact member 138 is partially deformed, creating a contact surface 139.

The contact member 138 can be made from a material that allows the resilient member 130 to have spring like forces under high energy impact to allow the strikeface 102 to deflect. The base 140 can comprise the parallel truss like structure to allow for stiffening combinations to control strikeface deflection, while ensuring the resilient member 130 remains as light as possible.

D. Second Embodiment

In some embodiment, illustrated at FIGS. 9-12, a golf club head 200 can comprise a resilient member 230 with an articulating recessed flexure zone. The articulating recessed flexure zone allow for the mandating and stabilizing CT across the strikeface while saving mass by removing material to form the flexure zone.

The resident member 230 can comprise a contact member 238 and a base 240. The resilient member 230 can be coupled to the sole internal surface 226 and extend upward in an accurate manner from the base end 232 to the free end 234. The base 240 can be of a solid construction comprising a forward surface 242 and a rearward surface 244. The forward surface 242 and rearward surface 244 can coverage and connect at the free end 234. The base 240 further comprises a base heel side 246 and a base toe side 248 wherein the base heel side 246 and base toe side 148 are parallel.

The base 240 can further comprise a relatively rigid section 290 extending from the base end 232 to an intermediate section 280. The intermediate section 280 can extend from the relatively rigid section 290 in a curved manner towards the strikeface 202. The intermediate section 180 can further comprise a flexure zone 282, wherein the flexure zone 282 extends from the intermediate section 180 to the free end 234. The flexure zone 282 can have an arcuate shape that can be concave relative to the sole 244 and can define an apex of the resilient member base 240. The flexure zone 282 can comprise a plurality of recesses that form a teethlike structure. The plurality of recesses can extend inward from the base rearward surface 244. The teethlike structure allows the resilient member 230 to flex in response to a high-energy impact.

In some embodiments, such as illustrated in FIGS. 9-12, the flexure zone 282 can comprise a plurality of recesses. The flexure zone 282 can comprise up to 10 notched recesses. The flexure zone 282 can comprise up to 4 recesses, up to 5 recesses, up to 6 recesses, up to 7 recesses, up to 8 recesses, up to 9 recesses, or up to 10 recesses.

The free end 234 can further comprise a post 235 wherein the post 235 comprises a receiving geometry 236 configured to receive a portion of the contact member 238. Similar to the previously described embodiment, the contact member 238 can be made from a material that allows the resilient member 230 to have spring like forces under high energy impact to allow the strikeface 202 to deflect. The contact member 238 comprises a complementary geometry 237 to the receiving geometry 236. The contact member 238 can comprise an external shape the external shape can be spherical. At rest the contact member 238 can be in constant contact with the strikeface rear surface 228 such that the contact member 238 is partially deformed, creating a contact surface 239.

Similar to the previously described embodiment, the contact member 238 can be made from a material that allows the resilient member 230 to have spring like forces under high energy impact to allow the strikeface 202 to deflect. The base 240 can comprise the combination of the flexure zone 282 and a relatively rigid section 290 comparing a plurality of support member 270 that span the void, allow for stiffening combinations to control strikeface deflection. The addition of the flexure zone 282 can allow for an increased deformation of the resilient member 230.

E. Third Embodiment

In a further embodiment illustrated at FIGS. 13-16, a golf club head 300 can comprise a resilient member 330 with an articulating flexure zone and a traditional truss like structure. The traditional truss like structure allows for increased durability allow the base to be thinned comparted to other embodiments. The resilient member 330 can comprise a contact member 338 and a base 340. The resilient member 330 can be coupled to the sole internal surface 326 and extend upward in an accurate manner from the base end 332 to the free end 334. The base 340 can have a construction with a void, that a first arm 350, a second arm 360, and a base end 332 form a void. The first arm 350 can further comprise the forward surface 342 and a first rearward surface 352 and the second arm 360 can further comprise a second forward surface 362 and the rearward surface 344.

The forward surface 342 and rearward surface 344 can coverage and connect at the free end 334. The base 140 further comprises a base heel side 346 and a base toe side 348 wherein the base heel side 346 and base toe side 348 are parallel.

The base 340 can further comprise a relatively rigid section 390 extending from the base end 332 to an intermediate section 380. The relatively rigid section 390 can comprise a plurality of support members 370 that can extend from the first rearward surface 352 to the second forward surface 362 to form a truss like structure. The plurality of support members 370 can be positioned such that 2 members of the plurality of support members 370 converge at a point along the base first rearward surface 352 and 2 members of the plurality of support members 370 converge at a point along the base second forward surface 362. The void and truss like structure within the relatively rigid section 390 ensures the durability of resilient member 330 without adding unnecessary mass.

The intermediate section 380 can extend from the relatively rigid section 390 in a curved manner towards the strikeface 302. The intermediate section 380 can further comprise a flexure zone 382, wherein the flexure zone 382 extends from the intermediate section 380 to the free end 334. The flexure zone 382 can have an arcuate shape that can be concave relative to the sole 314 and can define an apex of the resilient member base 340. The flexure zone 382 of the resilient member 330 can comprise a plurality of flexure voids. The flexure voids, as illustrated in FIGS. 13-16, can comprise flexure grooves formed in top and bottom surfaces of the resilient member base 340 residing in the flexure zone. The flexure grooves can alternate from the top to bottom surfaces to form a serpentine spring pattern to allow the resilient member 330 to flex during high-energy impact.

In some embodiments, such as illustrated in FIGS. 13-16, the flexure zone 382 can comprise a serpentine spring pattern. The flexure zone 382 can comprise up to 30 flexure grooves. The flexure zone can comprise up to 12, up to 14, up to 16, up to 18, up to 20, up to 22, up to 24, up to 26, up to 28, or up to 30 flexure grooves. The flexure grooves can be uniformly spaced from each other or have variable spacing.

The free end 334 can further comprise a post 335 wherein the post 335 comprises a receiving geometry 336 configured to receive a portion of the contact member 338. Similar to the previously described embodiment, the contact member 338 can be made from a material that allows the resilient member 330 to have spring like forces under high energy impact to allow the strikeface 302 to deflect. The contact member 338 comprises a complementary geometry 337 to the receiving geometry 336. The contact member 338 can comprise an external shape the external shape can be spherical. At rest the contact member 338 can be in constant contact with the strikeface rear surface 328 such that the contact member 338 is partially deformed, creating a contact surface 339.

Similar to the previously described embodiment, the contact member 338 can be made from a material that allows the resilient member 330 to have spring like forces under high energy impact to allow the strikeface 302 to deflect. The base 340 can comprise the combination of the flexure zone 382 and a relatively rigid section 390 comparing a plurality of support member 370 that span the void, allow for stiffening combinations to control strikeface deflection. The addition of the flexure zone 382 can allow for an increased deformation of the resilient member 330.

F. Fourth Embodiment

Figure 17:
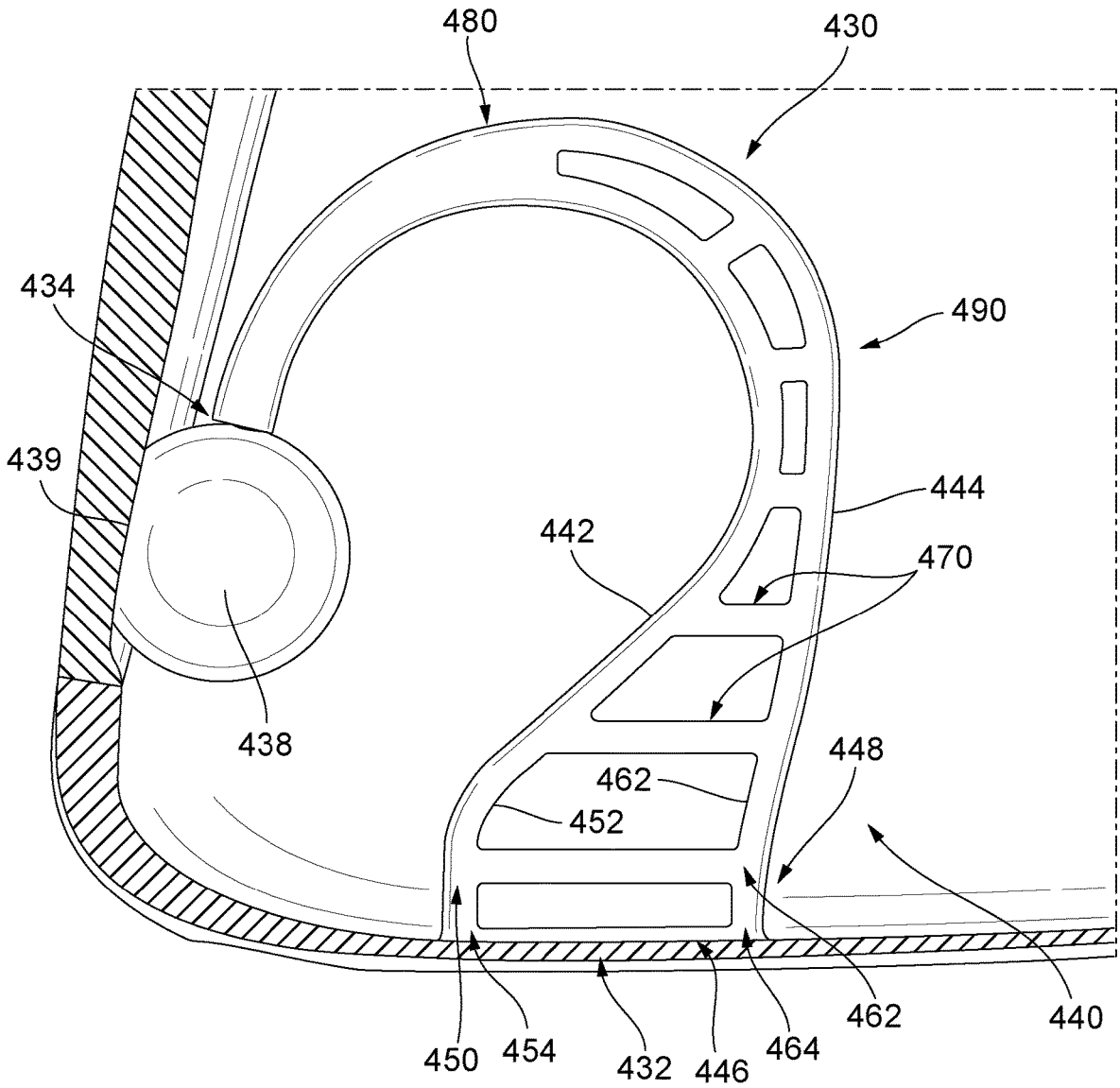
FIG. 17 illustrates a side view, in cross-section, of a wood-type golf club head with a moderated response.

In a further embodiment illustrated at FIGS. 17, a golf club head can comprise a resilient member 430 with an extreme truss like structure. The extreme truss like structure allows for the removal of maximum material while still ensuring durability and the moderating and stabilization of the strikeface.

The resilient 430 member can comprise a contact member 438 and a base 440. The resilient member 430 can be coupled to the sole internal surface 426 and extend upward in an accurate manner from the base end 432 to the free end 434. The base 440 can have a construction with a void, that a first arm 450, a second arm 460, and a base end 432 form a void. The first arm 450 can further comprise the forward surface 442 and a first rearward surface 452 and the second arm 460 can further comprise a second forward surface 462 and the rearward surface 444.

The forward surface 442 and rearward surface 444 can coverage and connect at the free end 434. The base 440 further comprises a base heel side 446 and a base toe side 448 wherein the base heel side 446 and base toe side 448 are parallel.

The base 440 can further comprise a relatively rigid section 490 extending from the base end 432 to an intermediate section 480. The relatively rigid section 490 can comprise a plurality of support members 470 that can extend from the first rearward surface 452 to the second forward surface 462 to form a truss like structure. The plurality of support members 470 is parallel to each other. The void and truss like structure within the relatively rigid section 490 ensures the durability of resilient member 430 without adding unnecessary mass.

The intermediate section 480 can extend from the relatively rigid section 490 in a curved manner towards the strikeface 402 to the free end 434. The free end 434 can further comprise a post 435 wherein the post 435 comprises a receiving geometry 436 configured to receive a portion of the contact member 438. Similar to the previously described embodiment, the contact member 438 can be made from a material that allows the resilient member 430 to have spring like forces under high energy impact to allow the strikeface 402 to deflect. The contact member 438 comprises a complementary geometry 437 to the receiving geometry 436. The contact member 438 can comprise an external shape the external shape can be spherical. At rest the contact member 438 can be in constant contact with the strikeface rear surface 428 such that the contact member 438 is partially deformed, creating a contact surface 439.

Similar to the previously described embodiment, the contact member 438 can be made from a material that allows the resilient member 430 to have spring like forces under high energy impact to allow the strikeface 402 to deflect. The base 440 can comprise the truss like structure to allow for stiffening combinations to control strikeface deflection, while ensuring the resilient member 430 remains as light as possible.

III. EXAMPLES

A. Example 1: FEA Control vs Stiff Member vs Flexible Member-Internal Energy Described herein is a comparison of a finite element analysis performed on three wood-type club heads, two of which comprise resilient members similar to those described above. The finite element analysis (FEA) simulated the internal energy of each club head given their different constructions. As discussed above, the addition of a resilient member in the club head can create performance improvements such as normalized impact response across the strikeface. Therefore, the purpose of the FEA comparison was to demonstrate any changes in other performance factors due to the addition of the different types of resilient members.

In a first performance test, a first exemplary club head and a second exemplary club head were compared to a first control club head. The first control club head consists of a stock club head. The first exemplary club head consists of a club head with a similar construction as the stock club head (i.e., body build, face thickness, etc.) with a resilient member similar to that illustrated in FIGS. 4-8. The second exemplary club head consists of a club head with a similar construction as the stock club head (i.e., body build, face thickness, etc.) with a resilient member similar to that illustrated in FIG. 17 and demonstrates similar bending properties as the resilient members with flexure zones, as described above.

Figure 19:
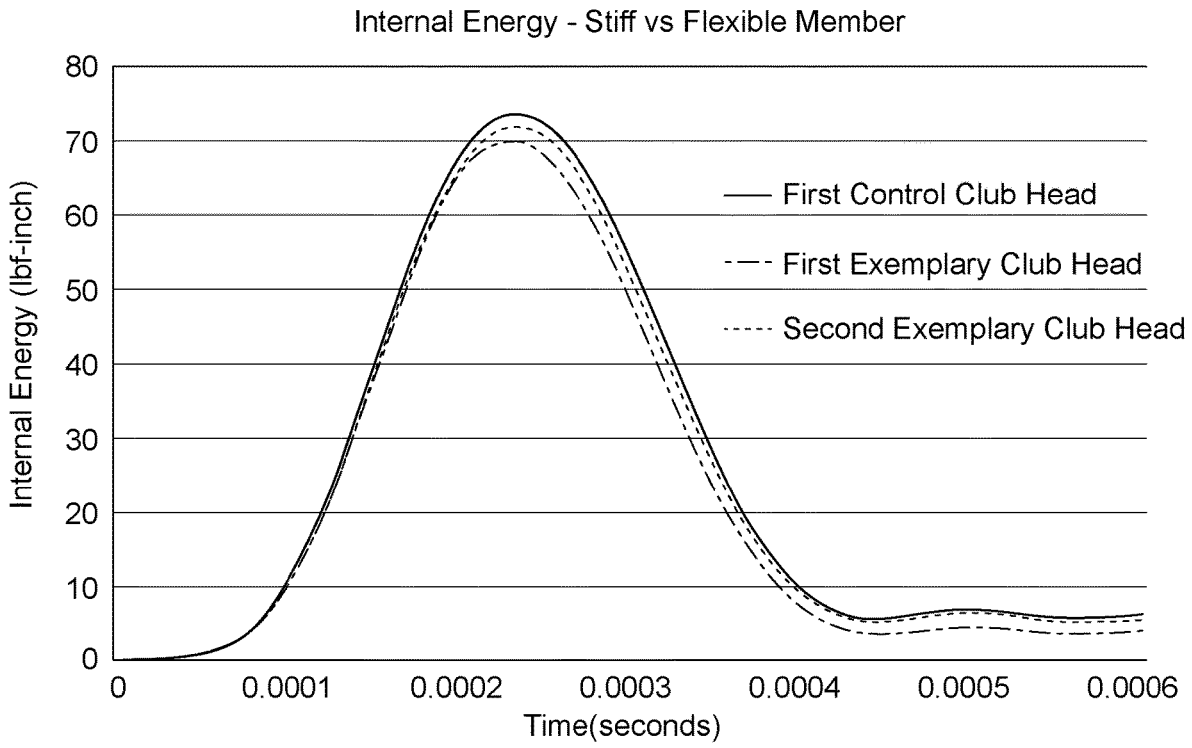
FIG. 19 illustrates a graph of internal energy over time amongst 3 wood-type club heads.

The FEA analysis simulated the internal energy (measured in pound-force inch) of the sample club heads. The sample club heads were tested at a swing speed of 100 mph to simulate real-world swing conditions. The first performance test results are illustrated in FIG. 19. The first exemplary club head had a peak internal energy of about 70.0 lbf-in. The second exemplary club head had a peak internal energy of about 72.0 lbf-in. The first control club head had a peak internal energy of about 73.5 lbf-in. As depicted in the plot of FIG. 19, there is not a large drop in internal energy from the first control club head to the second exemplary club head. Thus, there was not a significant drop in internal energy between a stock club head and a club head of similar construction with a resilient member. The drop in internal energy is less, when compared to a stock club head, for a resilient member that has a more flexible base than for a resilient member that has a relatively rigid base.

B. Example 2: FEA Control vs Flexible Members-Impact of Face Thickness on Internal Energy Further described herein is a comparison of a finite element analysis performed on three wood-type club heads, two of which comprise flexible resilient members similar to those described above. The finite element analysis (FEA) simulated the internal energy of each club head given their different constructions. As discussed above, the addition of a resilient member in the club head can create performance improvements such as normalized impact response across the strikeface. Therefore, the purpose of the FEA comparison was to demonstrate any changes in other performance factors due to the addition of the different types of resilient members.

In a second performance test, the second exemplary club head (as described above) and a third exemplary club head were compared to the first control club head (as described above). The second exemplary club head and first control club head are described above in Example 1. The third exemplary club head consists of a club head with a similar construction as the second exemplary club head, but with a strikeface that is 0.01 inches thinner.

Figure 20:
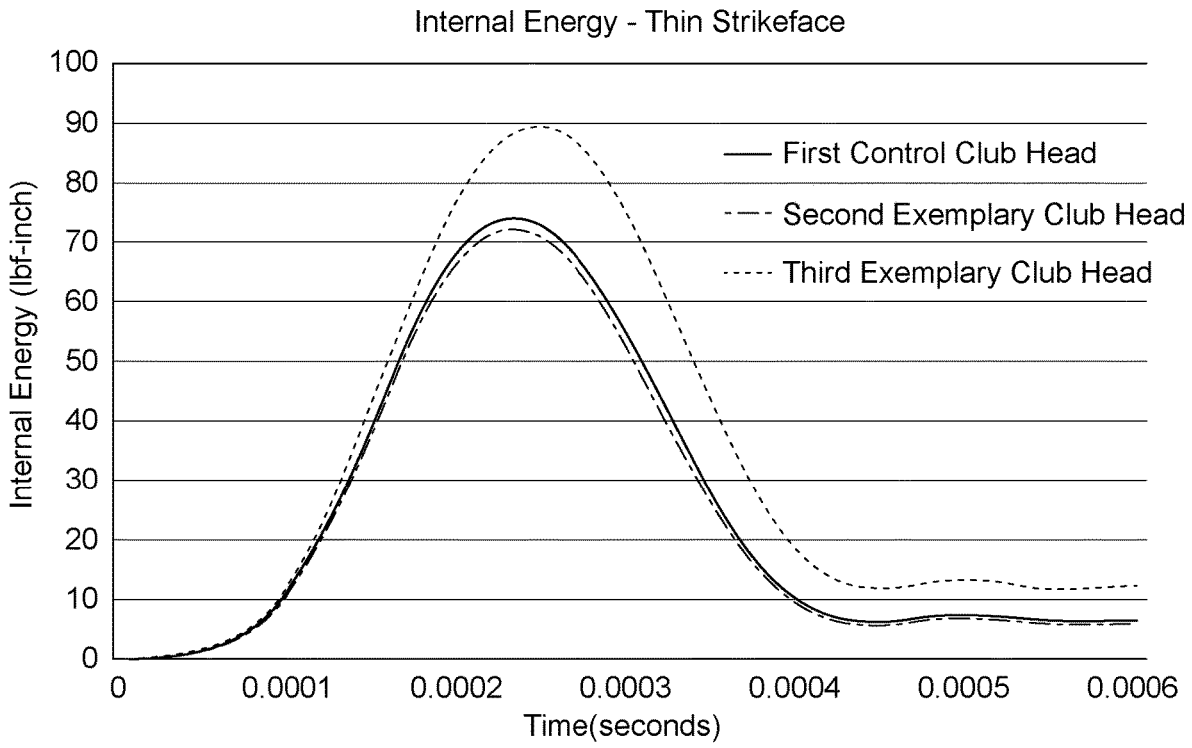
FIG. 20 illustrates a graph of internal energy over time amongst 3 wood-type club heads.

The FEA analysis simulated the internal energy of the sample club heads with the same parameters described above in Example 1. The second performance test results are illustrated in FIG. 20. The second exemplary club head had a peak internal energy of about 72.0 lbf-in and the first control club head had a peak internal energy of about 73.5 lbf-in, such as in Example 1. The third exemplary club head had a peak internal energy of about 89.8 lbf-in. As depicted in the plot of FIG. 20, there is a large increase in internal energy from the first control club head and from the second exemplary club head to the third exemplary club head, 22% and 24.7% respectively.

C. Example 3: Contact Member Behavior During Impact

Further described herein is a comparison of a finite element analysis performed on two wood-type club heads comprising two different resilient members. The finite element analysis (FEA) simulated the reaction force between the contact member and strikeface and the relative z-displacement of each club head given their different constructions. As discussed above, the addition of a resilient member in the club head can create performance improvements such as normalized impact response across the strikeface. Therefore, the purpose of the FEA comparison was to demonstrate differences in any performance factors between different types of resilient members.

In a third performance test, the first exemplary club head and second exemplary club head, as described above, were compared. The first exemplary club head and second exemplary club head are described above in Example 1. The FEA analysis simulated the reaction force (measured in pound-force) between the contact member and the strikeface of the sample club heads. Additionally, the FEA simulated the displacement of the free end tip of the sample clubs in a Z direction measured normal to the loft plane. The sample club heads were tested at a swing speed of 100 mph to simulate real-world swing conditions.

Figure 21A:
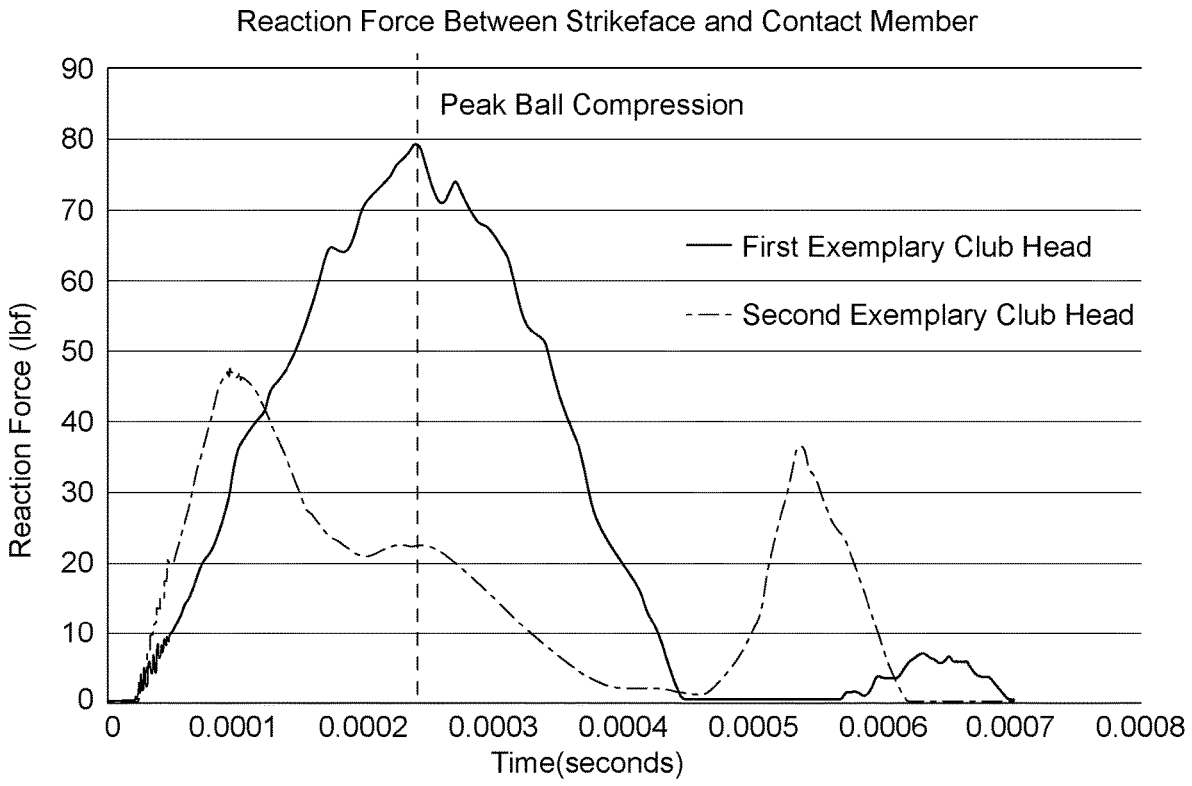
FIG. 21A illustrates a graph of reaction force over time amongst 2 wood-type club heads.
Figure 21B:
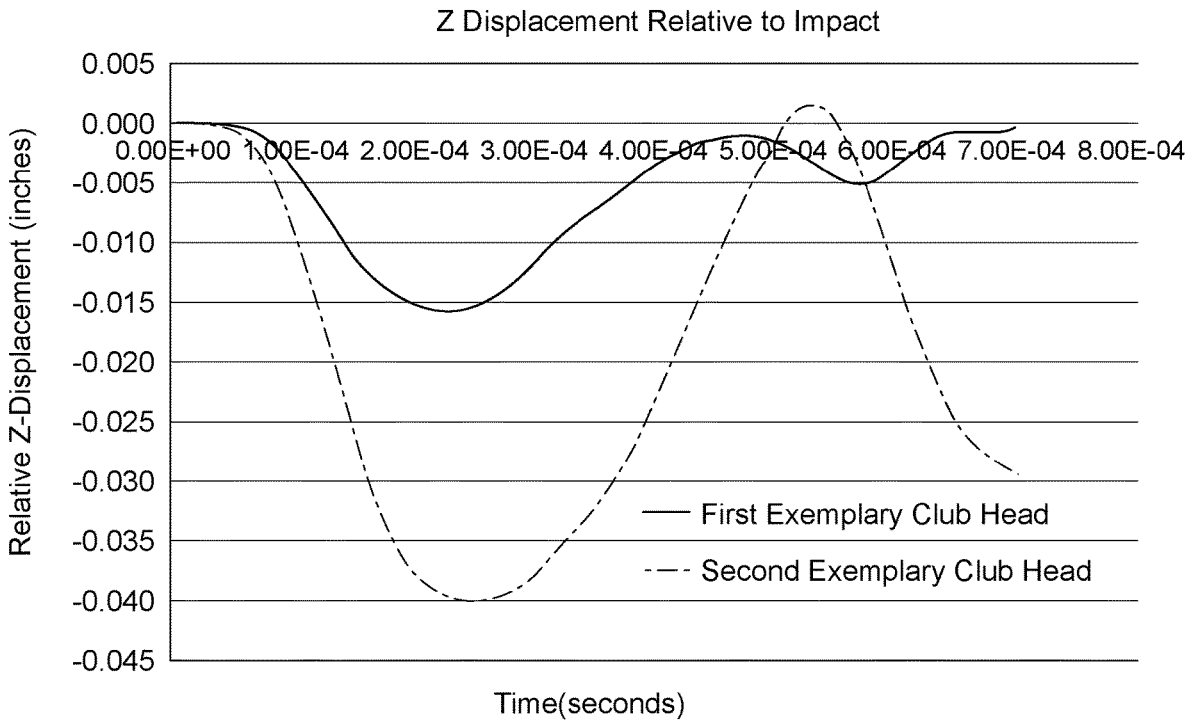
FIG. 21B illustrates a graph of displacement over time amongst 2 wood-type club heads.

The third performance test results are illustrated in FIGS. 21A and 21B. The first exemplary club head had a reaction force of about 79.0 lbf at peak golf ball compression. The second exemplary club head had a reaction force of about 22.5 lbf at peak golf ball compression. The reaction force directly correlates to the displacement of the free end tip. The first exemplary club head had a z displacement of about 0.0157 in at peak ball compression. The second exemplary club head had a z displacement of about 0.0394 in at peak ball compression.

FIG. 21A shows that the maximum resistance supplied by the first exemplary club head occurs at the peak golf ball compression. This is not the case for the second exemplary club head. The resistance force applied to the strikeface by the resilient member in the second exemplary club head is less at peak golf ball compression when compared to at other points during impact, as shown in FIG. 21A. Coupled with the data shown in FIG. 21B, the resilient member of the second exemplary club head moves away from the strikeface and provides less support at peak golf ball compression when compared to that of the first exemplary club head. The second exemplary club head provides less support under high impact force than under low impact force which will aid in normalizing impact force across the face. Additionally, in FIG. 21A, the slope of the reaction force over time is less steep for the first exemplary club head when compared to the second exemplary club head. The loading between the contact member and the base are more evenly loaded throughout impact for the first exemplary club head. For the second exemplary club head, the resistance is loaded more from the base end than from the contact member at these steeper slopes. The behavior at peak golf ball compression of the second exemplary club head is advantageous over the behavior at peak golf ball compression of the first exemplary club head, because there will be less of a loss in ball speed.

CLAUSES

Clause 1. A golf club head comprising: a crown, a sole, a heel end, a toe end, a front portion, and a rear that define an internal cavity; and a strikeface located at the front portion; wherein; the strikeface comprises a rear surface facing the internal cavity and a striking surface opposite the rear surface; the sole comprises an internal surface facing the internal cavity and an external surface opposite the internal surface; a resilient member disposed in the internal cavity and comprises: a base and a contact member; wherein: the base comprises a base end and free end, wherein the base end is coupled to the internal surface of the sole and the free end is proximate the rear surface of the strikeface; and the contact member is coupled to the base and configured to continuously engage the rear surface of the strikeface at rest.

Clause 2. The golf club of clause 1, wherein the base of the resilient member comprises: a first arm and a second arm; wherein the first arm comprises a forward surface and a first rearward surface and the second arm comprises a second forward surface and a rearward surface; a plurality of support members extends from the first rearward surface to the second forward surface within a relatively rigid section.

Clause 3. The golf club of clause 1, wherein the contact member is a spherical shape.

Clause 4. The golf club head of clause 1, wherein the resilient member comprises a base height measured as the distance from the ground plane to the topmost point of the base in a direction parallel to the y-axis between 0.50 inches and 1.50 inches.

Clause. 5. The golf club head of clause 1, wherein the base comprises a mass between 0.50 grams and 3.00 grams.

Clause 6. The golf club of clause 1, wherein the strikeface defines a thickness measured between the striking surface and the rear surface that is 10% thinner than that of a club without a resilient member.

Clause 7. The golf club of clause 1, wherein the contact member is a different material than the base.

Clause 8. The golf club of clause 7 wherein the contact member is made from a material selected from a group consisting natural rubber, synthetic rubber, and flexible TPE material.

Clause 9, The golf club head of clause 8, wherein the contact member has a harness between 45 A to 100 A.

Clause 10. The golf club of clause 7 wherein the base is made a material selected from a group consisting of composite, titanium, aluminum, and steel.

Clause 11. A golf club head comprising: a crown, a sole, a heel end, a toe end, a front portion, and a rear that define an internal cavity; and a strikeface located at the front portion; wherein: the strikeface comprises a rear surface facing the internal cavity and a striking surface opposite the rear surface; the sole comprises an internal surface facing the internal cavity and an external surface opposite the internal surface; a resilient member disposed in the internal cavity and comprising: a base and a contact member; wherein; the base comprises a base end and free end, wherein the base end is coupled to the internal surface of the sole and the free end is proximate the rear surface of the strikeface; and the contact member is coupled to the base and configured to continuously engage the rear surface of the strikeface at rest wherein; the base further comprises a relatively rigid section extending from the base end to an intermediate section, and a relatively flexible section extending from the intermediate section to the free end.

Clause 12. The golf club of clause 11, wherein the base of the resilient member comprises: a first arm and a second arm; wherein the first arm comprises a forward surface and a first rearward surface and the second arm comprises a second forward surface and a rearward surface; a plurality of support members extends from the first rearward surface to the second forward surface within a relatively rigid section.

Clause 13. The golf club of clause 11, wherein the contact member is a spherical shape.

Clause 14. The golf club head of clause 11, wherein the resilient member comprises a base height measured as the distance from the ground plane to the topmost point of the base in a direction parallel to the y-axis between 0.50 inches and 1.50 inches.

Clause 15. The golf club head of clause 11, wherein the base comprises a mass between 0.50 grams and 3.00 grams.

Clause 16. The golf club of clause 11, wherein the strikeface defines a thickness measured between the striking surface and the rear surface that is 10% thinner than that of a club without a resilient member.

Clause 17. The golf club of clause 11, wherein the contact member is a different material than the base.

Clause 18. The golf club of clause 17 wherein the contact member is made from a material selected from a group consisting natural rubber, synthetic rubber, and flexible TPE material.

Clause 19. The golf club head of clause 18, wherein the contact member has a harness between 45 A to 100 A.

Clause 20. The golf club of clause 17, wherein the base is made a material selected from a group consisting of composite, titanium, aluminum, and steel.

The invention claimed is:

1. A golf club head, comprising:

a crown, a sole, a heel end, a toe end, a front portion, and a rear that define an internal cavity;

a strikeface located at the front portion; wherein:

the strikeface comprises a rear surface facing the internal cavity and a striking surface opposite the rear surface; and the sole comprises an internal surface facing the internal cavity and an external surface opposite the internal surface; and a resilient member disposed in the internal cavity and comprising:

a base, comprising:

a base end coupled to the internal surface of the sole;

a free end proximate the rear surface of the strikeface;

a first arm comprising a first forward surface and a first rearward surface;

a second arm comprising a second forward surface and a second rearward surface; and a plurality of support members extending from the first rearward surface to the second forward surface within a relatively rigid section; and a contact member, wherein:

the contact member is a different material than the base; and the contact member is coupled to the base and configured to continuously engage the rear surface of the strikeface at rest.

2. The golf club head of claim 1, wherein the contact member is a spherical shape.

3. The golf club head of claim 1, wherein the resilient member comprises a base height measured as a distance from a ground plane to a topmost point of the base in a direction parallel to a y-axis between 0.50 inches and 1.50 inches.

4. The golf club head of claim 1, wherein the base comprises a mass between 0.50 grams and 3.00 grams.

5. The golf club head of claim 1, wherein the contact member is made from a material selected from a group consisting natural rubber, synthetic rubber, and flexible TPE material.

6. The golf club head of claim 5, wherein the contact member has a hardness between 45 A to 100 A.

7. The golf club head of claim 1, wherein the base is made a material selected from a group consisting of composite, titanium, aluminum, and steel.

8. A golf club head, comprising:

a crown, a sole, a heel end, a toe end, a front portion, and a rear that define an internal cavity;

a strikeface located at the front portion; wherein:

the strikeface comprises a rear surface facing the internal cavity and a striking surface opposite the rear surface;

the sole comprises an internal surface facing the internal cavity and an external surface opposite the internal surface; and a resilient member disposed in the internal cavity and comprising:

a base and a contact member; wherein:

the base comprises a base end and free end, wherein the base end is coupled to the internal surface of the sole and the free end is proximate the rear surface of the strikeface; and the contact member is coupled to the base and configured to continuously engage the rear surface of the strikeface at rest; and wherein the base further comprises a relatively rigid section extending from the base end to an intermediate section, and a relatively flexible section extending from the intermediate section to the free end.

9. The golf club head of claim 8, wherein the base of the resilient member comprises: a first arm and a second arm; wherein the first arm comprises a first forward surface and a first rearward surface and the second arm comprises a second forward surface and a second rearward surface; a plurality of support members extends from the first rearward surface to the second forward surface within the relatively rigid section.

10. The golf club head of claim 8, wherein the contact member is a spherical shape.

11. The golf club head of claim 8, wherein the resilient member comprises a base height measured as a distance from a ground plane to a topmost point of the base in a direction parallel to a y-axis between 0.50 inches and 1.50 inches.

12. The golf club head of claim 8, wherein the base comprises a mass between 0.50 grams and 3.00 grams.

13. The golf club head of claim 8, wherein the contact member is a different material than the base.

14. The golf club head of claim 13 wherein the contact member is made from a material selected from a group consisting natural rubber, synthetic rubber, and flexible TPE material.

15. The golf club head of claim 14, wherein the contact member has a hardness between 45 A to 100 A.

16. The golf club head of claim 13, wherein the base is made a material selected from a group consisting of composite, titanium, aluminum, and steel.

* * * * *